US007515121B2

(12) United States Patent
Sato et al.

(10) Patent No.: US 7,515,121 B2
(45) Date of Patent: Apr. 7, 2009

(54) LIGHT EMITTING ELEMENT DISPLAY APPARATUS AND DRIVING METHOD THEREOF

(75) Inventors: Kazuhito Sato, Fussa (JP); Hiroyasu Yamada, Hachioji (JP)

(73) Assignee: Casio Computer Co., Ltd., Tokyo (JP)

( * ) Notice: Subject to any disclaimer, the term of this patent is extended or adjusted under 35 U.S.C. 154(b) by 565 days.

(21) Appl. No.: 10/489,381

(22) PCT Filed: Jun. 11, 2003

(86) PCT No.: PCT/JP03/07430

§ 371 (c)(1),
(2), (4) Date: Mar. 11, 2004

(87) PCT Pub. No.: WO04/001714

PCT Pub. Date: Dec. 31, 2003

(65) Prior Publication Data

US 2004/0246241 A1 Dec. 9, 2004

(30) Foreign Application Priority Data

Jun. 20, 2002 (JP) ..... 2002-180284

(51) Int. Cl.

| | |
|---|---|
| ***G09G 3/30*** | (2006.01) |
| ***G09G 3/32*** | (2006.01) |
| ***G09G 5/00*** | (2006.01) |
| ***G09G 5/10*** | (2006.01) |
| ***G06F 3/038*** | (2006.01) |

(52) U.S. Cl. ..... 345/76; 345/77; 345/78; 345/79; 345/80; 345/81; 345/82; 345/83; 345/204; 345/205; 345/206; 345/690

(58) Field of Classification Search ..... 345/76–83, 345/204–206, 690

See application file for complete search history.

(56) References Cited

U.S. PATENT DOCUMENTS 5,680,149 A 10/1997 Koyama et al.

(Continued)

FOREIGN PATENT DOCUMENTS

EP 10146 501 A1 10/2001

(Continued)

OTHER PUBLICATIONS

Japanese Office Action dated Apr. 30, 2008, issued in counterpart Japanese application JP 2004-099535 of related U.S. Appl. No. 11/093,828.

(Continued)

*Primary Examiner*—Sumati Lefkowitz
*Assistant Examiner*—Alexander S. Beck
(74) *Attorney, Agent, or Firm*—Frishauf, Holtz, Goodman & Chick, P.C.

(57) ABSTRACT

A display apparatus includes signal lines to each of which a current is supplied to obtain an arbitrary current value, optical elements each optical behaving in accordance with the current value of the current flowing via the signal line, and a stationary voltage supply circuit for supplying a stationary voltage for setting the current value of the current flowing through the signal line to be stationary through the signal line.

24 Claims, 15 Drawing Sheets

U.S. PATENT DOCUMENTS

| | | | | |
|---|---|---|---|---|
| 6,023,259 | A | 2/2000 | Howard et al. | |
| 6,091,382 | A | 7/2000 | Shioya et al. | |
| 6,166,714 | A | 12/2000 | Kishimoto | |
| 6,229,506 | B1 * | 5/2001 | Dawson et al. | 345/82 |
| 6,373,454 | B1 | 4/2002 | Knapp et al. | |
| 6,377,235 | B1 * | 4/2002 | Murade et al. | 345/100 |
| 6,522,315 | B2 | 2/2003 | Ozawa et al. | |
| 6,577,302 | B2 | 6/2003 | Hunter et al. | |
| 6,650,060 | B2 | 11/2003 | Okuda | |
| 6,661,180 | B2 * | 12/2003 | Koyama | 315/169.3 |
| 6,667,580 | B2 * | 12/2003 | Kim et al. | 315/169.3 |
| 6,734,636 | B2 | 5/2004 | Sanford et al. | |
| 6,744,414 | B2 | 6/2004 | Lee et al. | |
| 6,750,833 | B2 | 6/2004 | Kasai | |
| 6,788,003 | B2 | 9/2004 | Inukai et al. | |
| 6,859,193 | B1 | 2/2005 | Yumoto | |
| 6,873,174 | B2 | 3/2005 | Matsunaga et al. | |
| 6,900,784 | B2 | 5/2005 | Tsuchida | |
| 6,930,680 | B2 | 8/2005 | Miyazawa | |
| 6,943,759 | B2 | 9/2005 | Tam | |
| 6,947,019 | B2 * | 9/2005 | Sato et al. | 345/82 |
| 2001/0017618 | A1 | 8/2001 | Azami | |
| 2001/0035863 | A1 | 11/2001 | Kimura | |
| 2001/0052606 | A1 | 12/2001 | Sempel et al. | |
| 2002/0014852 | A1 | 2/2002 | Bae | |
| 2002/0075208 | A1 | 6/2002 | Bae et al. | |
| 2002/0135309 | A1 | 9/2002 | Okuda | |
| 2002/0163514 | A1 | 11/2002 | Nagai et al. | |
| 2002/0195968 | A1 | 12/2002 | Sanford et al. | |
| 2003/0020335 | A1 | 1/2003 | Komiya | |
| 2003/0098708 | A1 | 5/2003 | Matsueda | |
| 2004/0036664 | A1 | 2/2004 | Miyazawa | |
| 2004/0113873 | A1 | 6/2004 | Shirasaki | |
| 2004/0165003 | A1 | 8/2004 | Shirasaki | |
| 2004/0183791 | A1 | 9/2004 | Yoshida et al. | |
| 2004/0256617 | A1 | 12/2004 | Yamada et al. | |
| 2005/0140610 | A1 | 6/2005 | Smith et al. | |
| 2005/0157581 | A1 | 7/2005 | Shiurasaki et al. | |
| 2005/0219168 | A1 | 10/2005 | Shirasaki et al. | |
| 2006/0119552 | A1 | 6/2006 | Yumoto | |
| 2006/0214890 | A1 | 9/2006 | Morshige et al. | |

FOREIGN PATENT DOCUMENTS

| | | | |
|---|---|---|---|
| EP | 1 170 718 | A1 | 1/2002 |
| EP | 1 372 136 | A1 | 12/2003 |
| EP | 1 443 483 | A2 | 8/2004 |
| JP | 1-123292 | A | 5/1989 |
| JP | 2506840 | B2 | 4/1996 |
| JP | 8-330600 | A | 12/1996 |
| JP | 11-143429 | A | 5/1999 |
| JP | 2000-221942 | A | 8/2000 |
| JP | 2001-147659 | A | 5/2001 |
| JP | 2002-149125 | A | 5/2002 |
| JP | 2002-215095 | A | 7/2002 |
| JP | 2003-066908 | A | 3/2003 |
| JP | 2003-076327 | A | 3/2003 |
| JP | 2003-195810 | A | 7/2003 |
| JP | 2003-529805 | A | 10/2003 |
| JP | 2004-021219 | A | 1/2004 |
| KR | 2000-0071301 | A | 11/2000 |
| TW | 331599 | | 5/1998 |
| TW | 582011 | | 4/2004 |
| WO | WO 99/65011 | A2 | 12/1999 |
| WO | WO 01/06484 | A1 | 1/2001 |
| WO | WO 01/20591 | A1 | 3/2001 |
| WO | WO 01/75852 | A1 | 10/2001 |
| WO | WO 02/39420 | A1 | 5/2002 |
| WO | WO 03/058328 | A1 | 7/2003 |
| WO | WO 04/001714 | A1 | 12/2003 |

OTHER PUBLICATIONS

Japanese Office Action dated Jun. 24, 2008, issued in counterpart Japanese application JP 2004-009146 of related U.S. Appl. No. 11/035,269.

Taiwanese Office Action (and English translation thereof) dated Oct. 28, 2008, issued in a counterpart Taiwanese Application of related U.S. Appl. No. 11/093,828.

* cited by examiner

LIGHT EMITTING ELEMENT DISPLAY APPARATUS AND DRIVING METHOD THEREOF

This application is a U.S. National Phase Application under 35 USC 371 of International Application PCT/JP03/07430 filed Jun. 11, 2003.

TECHNICAL FIELD

The present invention relates to a display apparatus including an optical element which performs an optical operation in accordance with a current value, in particular, a light emitting element which emits light with a luminance in accordance with the current value for each pixel, and a driving method of the apparatus.

BACKGROUND ART

In general, a display apparatus includes an apparatus of a passive driving system such as a simple matrix, and an apparatus of an active matrix driving system in which a switching transistor is disposed for each pixel. In a liquid crystal display of an active matrix driving system, as shown in FIG. 16, a liquid crystal element 501 which also functions as a condenser and which includes a liquid crystal, and a transistor 502 which functions as a switching element are disposed for each pixel. In the active matrix driving system, when a pulse signal is inputted into a scanning line 503 by a scanning driver in a selection period to select the scanning line 503, and when a voltage for controlling transmittance of the liquid crystal is applied to a signal line 504 by a data driver, the voltage is applied to the liquid crystal element 501 via the transistor 502. In the liquid crystal element, liquid crystal molecules are oriented in a direction in accordance with the applied voltage to appropriately displace the transmittance of a light transmitted through the liquid crystal element. Even when the transistor 502 is brought in an off state in a non-selection period after the selection period, the liquid crystal element 501 functions as a condenser. Therefore, electric charges are held in accordance with a voltage value in an allowable range till the next selection period, and so the orientation direction of the liquid crystal molecules is maintained in the period. As described above, a liquid crystal display is a display apparatus of a voltage control system in which a voltage is newly written so as to obtain the light transmittance of the liquid crystal element 501 at a selection period time, and arbitrary gradation representation is performed in accordance with the voltage value.

On the other hand, the display apparatus in which an organic EL element is used as a self-luminous element does not require a backlight differently from the liquid crystal display, and is optimum for miniaturization. Moreover, there is not any restriction of a visual field angle differently from the liquid crystal display, and therefore practical use of the display apparatus for the next generation has largely been expected. Different from the liquid crystal element, the organic EL element emits the light by a current flowing inside. Therefore, an emission luminance does not directly depend on the voltage, and depends on current density.

From viewpoints of high luminance, contrast, and fineness, also in the organic EL display, there has been a demand especially for the active matrix driving system in the same manner as in the liquid crystal display. For the organic EL display, the current flowing in the selection period has to be increased in the passive driving system. On the other hand, in the active matrix driving system, an element for holding the voltages applied to opposite ends of the organic EL element is disposed for each pixel in order to maintain continuous emission of each organic EL element at a predetermined luminance so that the light is emitted even in the non-selection period. Therefore, the current value of the flowing current per unit time may be small. However, the organic EL element has only a remarkably small capacity as the condenser. Therefore, when the organic EL element is simply disposed instead of the liquid crystal element 501 in the circuit of the pixel shown in FIG. 16, it is difficult for the organic EL element to maintain the emission in the non-selection period.

To solve the problem, for example, as shown in FIG. 17, in the organic EL display of the active matrix driving system, an organic EL element 601 which emits the light at a luminance proportional to the current value of the current flowing inside, a transistor 602 which functions as a switching element, and a transistor 605 for passing a driving current through the organic EL element 601 in accordance with a gate voltage applied by the transistor 602 are disposed for each pixel. In this display, when the pulse signal is inputted into a scanning line 603 by a scanning driver in the selection period to select the transistor 605 connected to the scanning line 603, a signal voltage for passing a driving current having a predetermined current value through the transistor 605 is applied to a signal line 604 by the data driver. Then, the voltage is applied to a gate electrode of the transistor 605, and luminance data is written in the gate electrode of the transistor 605. Accordingly, the transistor 605 is brought into the on state, the driving current having a gradation in accordance with the voltage value applied to the gate electrode flows through the organic EL element 601 from a power via the transistor 605, and the organic EL element 601 emits the light at the luminance in accordance with the current value of the driving current. In the non-selection period after the selection period, even when the transistor 602 is in an off state, the electric charges continue to be held in accordance with a voltage between gate and source of the transistor 605 by a parasitic capacity between the gate and source of the transistor 605, and accordingly the driving current continues to be passed through the organic EL element 601. As described above, the driving current is principally controlled by the voltage value of the gate voltage of the transistor 605 outputted in the selection period to emit the light from the organic EL element 601 at a predetermined gradation luminance.

In general, for the transistor, a channel resistance depends on an ambient temperature, and the channel resistance changes by the use for a long time. Therefore, a gate threshold voltage changes with elapse of time, and the gate threshold voltage of each transistor in the same display region varies. Therefore, when the voltage value of the voltage applied to the gate electrode of the transistor 605 is controlled, the value of the current flowing through the organic EL element 601 is controlled. In other words, when a level of the voltage applied to the gate electrode of the transistor 605 is controlled, it is difficult to exactly control the luminance of the organic EL element 601.

To solve the problem, a technique of controlling the luminance by the current value of the current, not by the level of the voltage applied to the transistor has been researched. That is, instead of a voltage designating system in which the level of the gate voltage is designated in the signal line, a current designating system in which the current value of the current flowing through the organic EL element is directly designated for the signal line is applied to the active matrix driving system of the organic EL display.

However, in the organic EL display of the current designating system, the current value of the designated current is constant in the selection period when the designated current is passed. However, when the current value of the designated current is small, much time is required until the voltage is brought into a stationary state by the designated current. Therefore, the organic EL element does not emit the light at a desired luminance, and this results in a drop in display quality of the organic EL display.

On the other hand, when the selection period is lengthened, selection time becomes longer than a time for bringing the voltage into the stationary state. However, when the selection time lengthens, a display screen blinks. In this manner, the drop in the display quality of the organic EL display is caused.

Therefore, an advantage of the present invention is to perform high-quality display.

DISCLOSURE OF THE INVENTION

To obtain the above-described advantage, according to one aspect of the present invention, for example, as shown in FIGS. 1, 10, 12, 13, 15, there is provided a display apparatus comprising:

a plurality of pixels (e.g., pixels $P_{i,j}$) which are disposed in intersecting portions of a plurality of scanning lines arranged in a plurality of rows (e.g., selection scanning lines $X_1$ to $X_m$, power scanning lines $Z_1$ to $Z_m$) and a plurality of signal lines arranged in a plurality of columns (e.g., signal lines $Y_1$ to $Y_n$) and which comprise optical elements (e.g., organic EL elements $E_{i,j}$) optically operating by a driving current flowing in accordance with a gradation current from the signal line; and reset means (e.g., current/voltage changeover portions 7, 107) for setting a potential of the signal line in accordance with electric charges charged in the signal line by the gradation current to a reset voltage (e.g., a reset voltage $V_R$).

In the present invention, when the pixel of the predetermined row is selected, the gradation current flows through each signal line. However, even when a difference between the potential set to be stationary by the gradation current flowing through the signal line for the pixel of the previous row and the potential of the signal line to be set to be stationary by the gradation current passed through the signal line for the pixel of the next row is large, and the current value of the gradation current for the next pixel is small, a reset voltage is applied to the signal line immediately before the next row. Therefore, the signal line can quickly be set to be stationary at the voltage in accordance with the gradation current for the next row.

Moreover, according to another aspect of the present invention, there is provided a display apparatus comprising:

a signal line (e.g., signal lines $Y_1$ to $Y_n$) to which a current is supplied so as to obtain an arbitrary current value;

an optical element (e.g., organic EL elements $E_{i,j}$) which optically behaves in accordance with the current value of the current flowing via the signal line; and stationary voltage supply means for supplying a stationary voltage which sets the current value of the current flowing through the signal line to be stationary to the signal line (e.g., current/voltage changeover portions 7, 107).

In the present invention, when a micro current is passed through the signal line, at the current value of the micro current, the electric charges accumulated in a capacity connected to the signal line beforehand are insufficiently shifted in a predetermined period, and so it is difficult to set the current value of the micro current to be stationary. Even in this case, since the stationary voltage supply means supplies the stationary voltage to the signal line, an electric charge amount of the capacity connected to the signal line can forcibly be changed so that the micro current passed through the signal line can quickly be set to be stationary.

According to another aspect of the present invention, there is provided a driving method of a display apparatus comprising a plurality of pixels (e.g., pixels $P_{i,j}$) which are disposed in intersecting portions of a plurality of scanning lines arranged in a plurality of rows (e.g., selection scanning lines $X_1$ to $X_m$, power scanning lines $Z_1$ to $Z_m$) and a plurality of signal lines arranged in a plurality of columns (e.g., signal lines $Y_1$ to $Y_n$) and which comprise optical elements (e.g., organic EL elements $E_{i,j}$) optically operating by a driving current flowing in accordance with a gradation current from the signal line, the method comprising:

a gradation current step of passing the gradation current through the signal lines; and a reset voltage step of displacing a potential in accordance with electric charges charged in the signal lines setting by the gradation current to a reset voltage.

In the driving method of the display apparatus according to the present invention, since the potential in accordance with the electric charges charged in the signal lines by the gradation current in the gradation current step is displaced to the reset voltage at the reset voltage step, the current flowing through the signal line can quickly be set to be stationary at an arbitrary current value.

BEST MODE FOR CARRYING OUT THE INVENTION

First Embodiment

Concrete modes of the present invention will be described hereinafter with reference to the drawings. Additionally, the scope of the present invention is not limited to shown examples.

Figure 1:
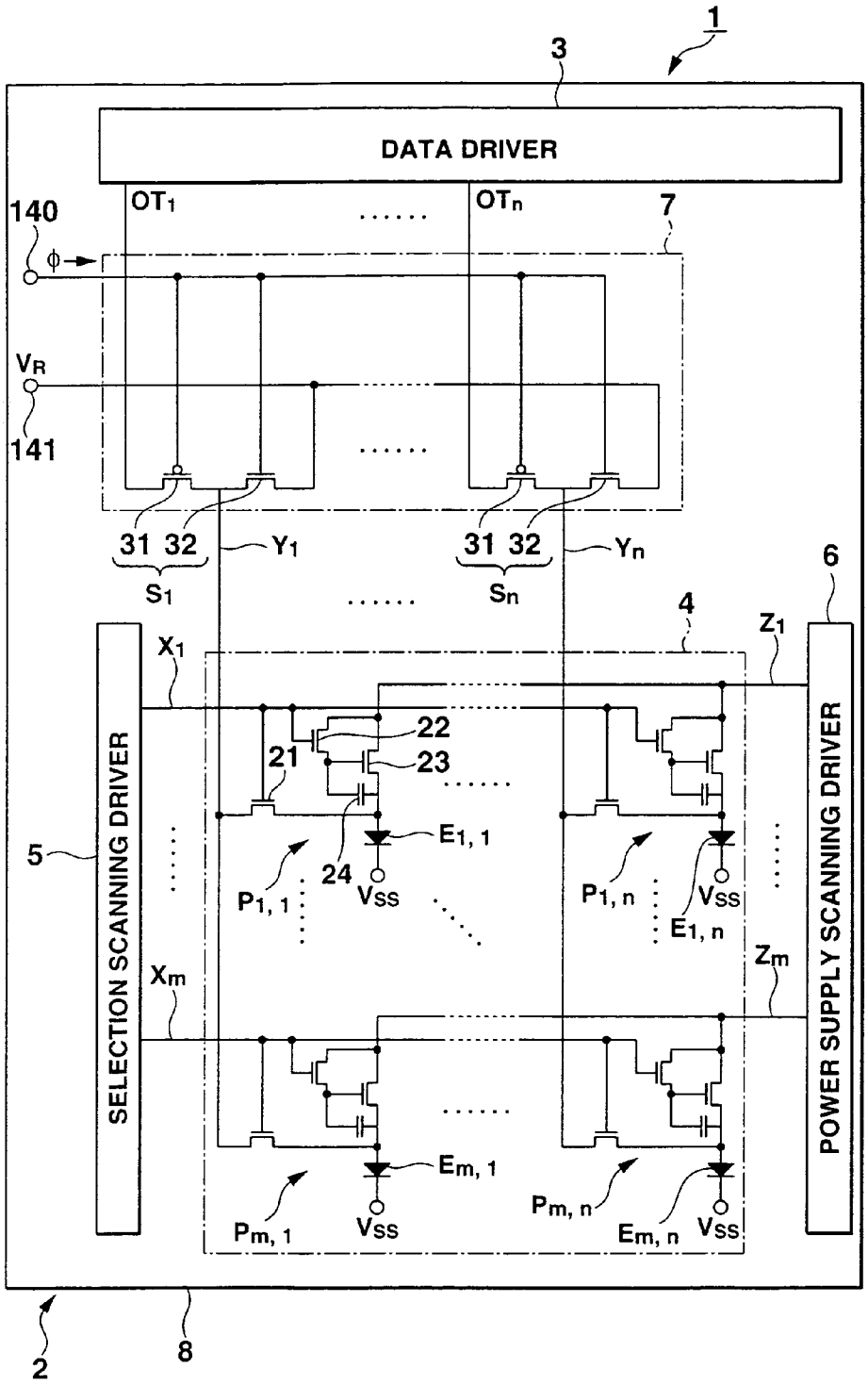
FIG. 1 is a circuit diagram showing a concrete mode of a display apparatus to which the present invention is applied.

FIG. 1 is a diagram showing a display apparatus to which the present invention is applied. As shown in FIG. 1, a display apparatus 1 is basically constituted to include an organic EL display panel 2 which performs color display by an active matrix driving system, and a data driver 3 which passes a gradation designating current (gradation current) sink through the organic EL display panel 2. Here, a sink current is a current flowing in a direction of each of signal lines $Y_1$ to $Y_n$ from each of pixels $P_{1,1}$ to $P_{m,n}$ described later.

The organic EL display panel 2 includes: a transparent substrate 8; a display portion 4 as a display region in which an image is substantially displayed; a selection scanning driver 5 disposed around the display portion 4, that is, in a non-display region; a power scanning driver 6; and a current/voltage changeover portion 7, to form a basic constitution. These circuits 4 to 7 are formed on the transparent substrate 8.

In the display portion 4, (m×n) pixels $P_{1,1}$ to $P_{m,n}$ (m, n are arbitrary natural numbers) are disposed on the transparent substrate 8 in a matrix form. In a column direction, that is, a longitudinal direction, m pixels $P_{1,j}$ to $P_{m,j}$ (j is an arbitrary natural number, $1 \leqq j \leqq n$) are disposed. Moreover, in a row direction, that is, in a lateral direction, n pixels $P_{i,1}$ to $P_{i,n}$ (i is an arbitrary natural number, $1 \leqq i \leqq m$) are disposed. That is, a pixel which is i-th (i.e. i-th row) from above in the longitudinal direction and j-th (i.e., j-th column) from the left in the lateral direction is a pixel $P_{i,j}$.

In the display portion 4, m selection scanning lines $X_1$ to $X_m$ extending in a row direction are juxtaposed in a column direction on the transparent substrate 8. The m power scanning lines $Z_1$ to $Z_m$ extending in the row direction are disposed opposite to selection scanning lines $X_1$ to $X_m$ and juxtaposed in the column direction on the transparent substrate 8. Each power scanning line $Z_k$ ($1 \leqq k \leqq m-1$) is disposed between selection scanning lines $X_k$ and $X_{k+1}$, and selection scanning line $X_m$ is disposed between power scanning lines $Z_{m-1}$ and $Z_m$. The n signal lines $Y_1$ to $Y_n$ extending in the column direction are juxtaposed in the row direction on the transparent substrate 8, and these selection scanning lines $X_1$ to $X_m$, power scanning lines $Z_1$ to $Z_m$, and signal lines $Y_1$ to $Y_n$ are insulated from one another by insulation films disposed among these. The selection scanning line $X_i$ and power scanning line $Z_i$ are connected to n pixels $P_{i,1}$ to $P_{i,n}$ arranged in the row direction, the signal line $Y_j$ is connected to m pixels $P_{1,j}$ to $P_{m,j}$ arranged in the column direction, and the pixel $P_{i,j}$ is disposed in a position surrounded with the selection scanning line $X_i$, power scanning line $Z_i$, and signal line $Y_j$.

Figure 2:
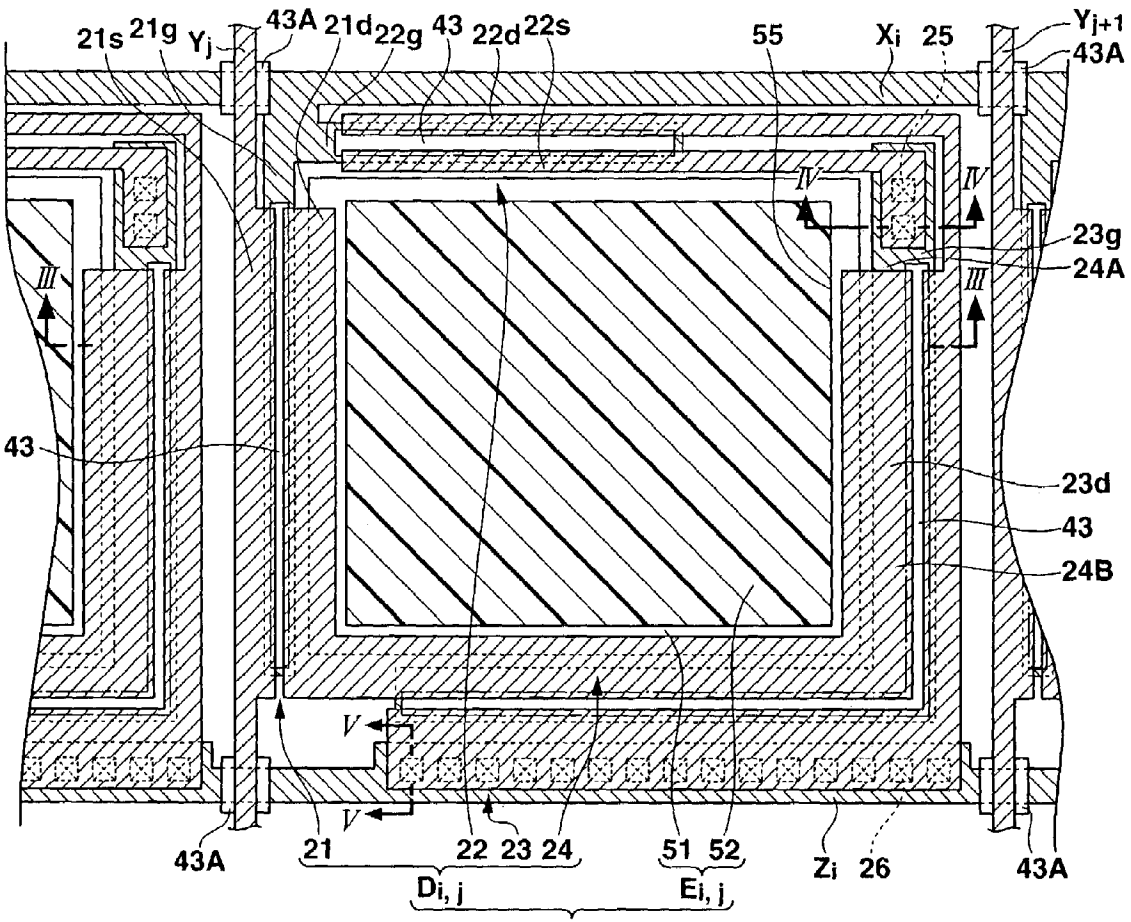
FIG. 2 is a schematic plan view showing a pixel of FIG. 1.
Figure 3:
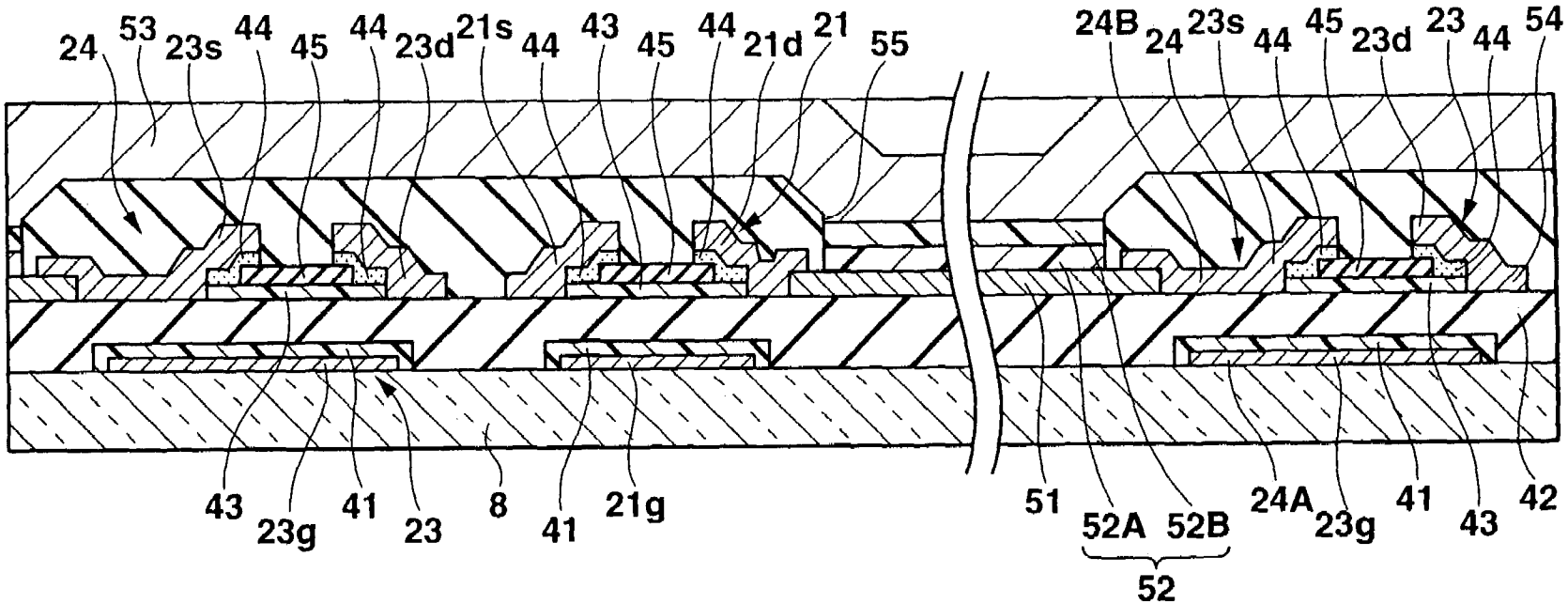
FIG. 3 is a sectional view along line III-III of FIG. 2.
Figure 4:
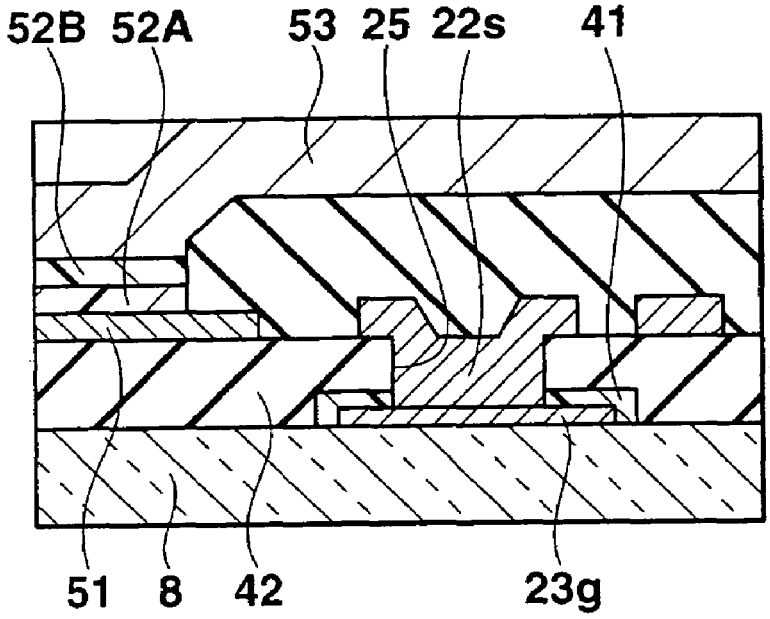
FIG. 4 is a sectional view along line IV-IV of FIG. 2.
Figure 5:
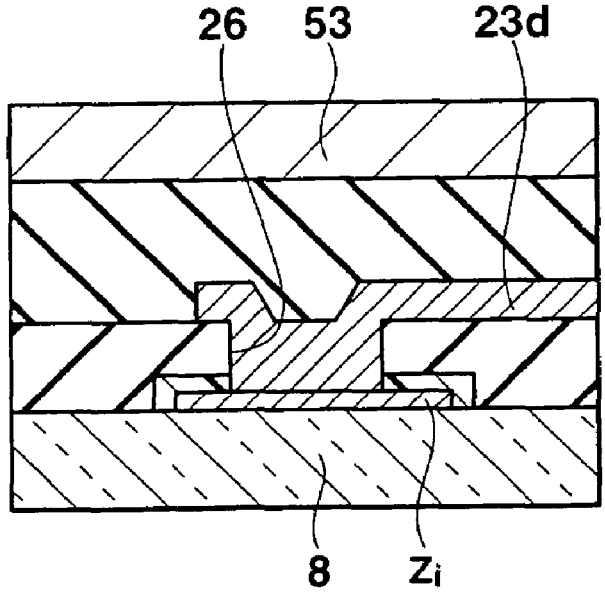
FIG. 5 is a sectional view along line V-V of FIG. 2.
Figure 6:
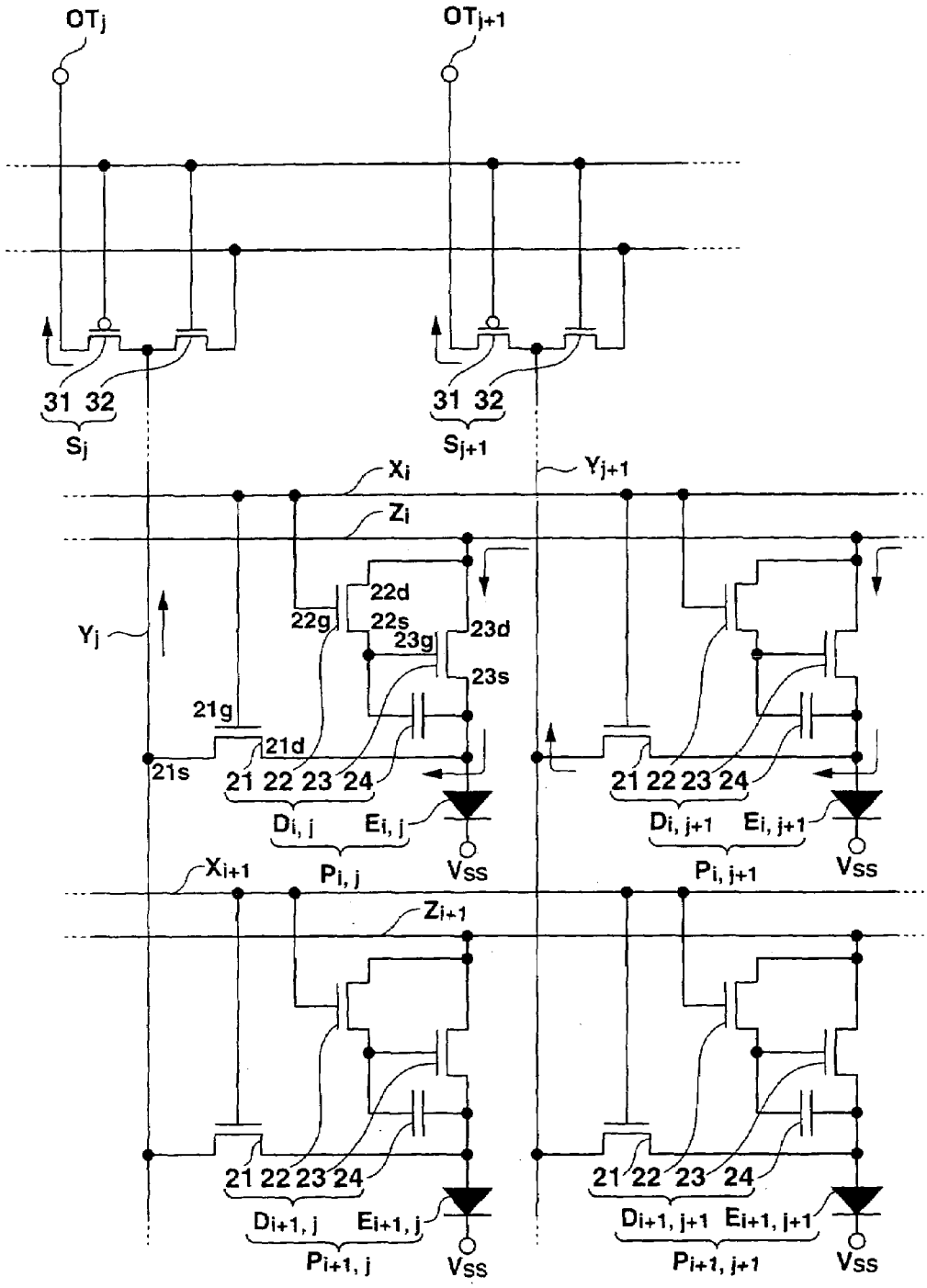
FIG. 6 is a circuit diagram showing a plurality of pixels arranged in a matrix form.

Next, each pixel $P_{i,j}$ will be described with reference to FIGS. 2, 3, 4, 5, and 6. FIG. 2 is a plan view showing the pixel $P_{i,j}$. To facilitate understanding, oxidation insulation films 41, channel protective insulation films 45, and a common electrode 53 are omitted from the figure. FIG. 3 is a sectional view along line III-III of FIG. 2, FIG. 4 is a sectional view along line IV-IV of FIG. 2, and FIG. 5 is a sectional view along line V-V of FIG. 2. FIG. 6 is an equivalent circuit diagram of four adjacent pixels $P_{i,j}$, $P_{i+1,j}$, $P_{i,j+1}$, $P_{i+1,j+1}$.

The pixel $P_{i,j}$ is constituted of an organic EL element $E_{i,j}$ which emits light at a luminance in accordance with the current value of the driving current, and a pixel circuit $D_{i,j}$ which is disposed around the organic EL element $E_{i,j}$ and which drives the organic EL element $E_{i,j}$. The pixel circuit $D_{i,j}$ holds the current value of the current flowing through the organic EL element $E_{i,j}$ in a given emission period based on signals outputted from the data driver 3, selection scanning driver 5, and power scanning driver 6 to hold an emission luminance of the organic EL element $E_{i,j}$ to be constant for a predetermined period.

The organic EL element $E_{i,j}$ includes a stacked structure in which a pixel electrode 51 functioning as an anode on the transparent substrate 8, an organic EL layer 52, and the common electrode 53 function as a cathode are stacked in order. The organic EL layer includes function of transporting a hole and electron implanted by an electric field, and includes a re-bonding region in which the transported hole and electron are re-bonded and an emission region in which an exciton generated by the re-bonding is captured to emit the light to function as an emission layer in a broad sense.

The pixel electrode 51 is patterned to be divided for each pixel $P_{i,j}$ in regions surrounded with two signal lines disposed adjacent to each other in the signal lines $Y_1$ to $Y_n$ and two lines disposed adjacent to each other in the selection scanning lines $X_1$ to $X_m$. A peripheral edge of the electrode is coated with an interlayer insulation film 54 including silicon nitride or silicon oxide with which three transistors 21, 22, 23 of each pixel circuit $D_{i,j}$ are coated, and a middle upper surface of the electrode is exposed by a contact hole 55 of the interlayer insulation film 54. For the interlayer insulation film 54, a second layer formed of the insulation film made of such as polyimide may further be disposed on a first layer of silicon nitride or silicon oxide.

The pixel electrode 51 has not only conductivity but also a transmission property to a visible light. The pixel electrode 51 has a relatively high work function, and preferably efficiently implants the hole into the organic EL layer 52. For example, the pixel electrode 51 is formed of films including main components such as tin-doped indium oxide (ITO), zinc-doped indium oxide, indium oxide ($In_2O_3$), tin oxide ($SnO_2$) and zinc oxide (ZnO).

The organic EL layer 52 is formed in the film on each pixel electrode 51. The organic EL layer 52 is also patterned for each pixel $P_{i,j}$. The organic EL layer 52 contains an emission material (fluorescent material) which is an organic compound, but the emission material may be either a polymer-based material or a low-molecular material. For example, as shown in FIG. 3, the organic EL layer 52 may also include a double layer structure in which a hole transport layer 52A and an emission layer 52B in a narrow sense are disposed in order from a pixel electrode 51 side. The emission layer includes the re-bond region in which the electron and hole are re-bonded and the emission region in which the exciton generated by the re-bonding is captured to emit the light. The layer may also include: a three-layers structure including the hole transport layer, the emission layer in the narrow sense, and the electron transport layer in order from the pixel electrode 51 side; a one-layer structure including the emission layer in the narrow sense; a stacked structure in which an implantation layer of the electron or hole is disposed between appropriate layers in the layer structure; or another layer structure.

In the organic EL display panel 2, full color display or multi-color display is possible. In this is case, the organic EL layers 52 of the respective pixels $P_{i,1}$ to $P_{i,n}$ are emission layers in the broad sense, which have, for example, a function of emitting the light of any of red, green, blue. That is, when each of the pixels $P_{i,1}$ to $P_{i,n}$ selectively emits the light of red, green, blue, color tone obtained by appropriately synthesizing these colors can be displayed.

The organic EL layer 52 is preferably formed of an electronically neutral organic compound, and accordingly the hole and electron are implanted and transported by the organic EL layer 52. A material having an electron transport property may appropriately be mixed in the emission layer in the narrow sense, a material having a hole transport property may appropriately be mixed in the emission layer in the narrow sense, or the materials having the electron and hole transport properties may appropriately be mixed in the emission layer in the narrow sense. A charge transport layer which is an electron transport layer or a hole transport layer may function as the re-bond region, and the fluorescent material may also be mixed in the charge transport layer to emit the light.

The common electrode 53 formed on the organic EL layer 52 is one electrode connected to all the pixels $P_{1,1}$ to $P_{m,n}$. Instead, the common electrode 53 may also be a plurality of striped electrodes connected to each column, constituted of a striped common electrode connected to a group of pixels $P_{1,h-1}$ to $P_{m,h-1}$ (h is an arbitrary natural number and $2 \leqq h \leqq n$) of the column direction, or a striped common electrode connected to a group of pixels $P_{1,h}$ to $P_{m,h}$. Additionally, the common electrode may also be a plurality of striped electrodes connected to each column, constituted of a striped common electrode connected to a group of pixels $P_{g-1,1}$ to $P_{g-1,n}$ (g is an arbitrary natural number and $2 \leqq g \leqq n$) of the row direction, to a striped common electrode connected to a group of pixels $P_{g,1}$ to $P_{g,n}$.

In any case, the common electrode 53 is electrically insulated from the selection scanning line $X_i$, signal line $Y_j$, and power scanning line $Z_i$. The common electrode 53 is formed of materials having a low work function, such as one unit including at least one of indium, magnesium, calcium, lithium, barium, and rare earth metal, and an alloy. The common electrode 53 may also include the stacked structure in which a plurality of layers of various material are stacked. Concretely, the common electrode may include a stacked structure of a high-purity barium layer having a low work function, disposed on an interface side in contact with the organic EL layer 52, and an aluminum layer with which the barium layer is coated, or a stacked structure in which the lithium layer is disposed in a lower layer and the aluminum layer is disposed in an upper layer. When the pixel electrode 51 is assumed to be a transparent electrode, and the light emitted from the organic EL layer 52 of the organic EL display panel 2 is emitted via the pixel electrode 51 on a transparent substrate 8 side, the common electrode 53 preferably has a shield property with respect to the light emitted from the organic EL layer 52, and further preferably has a high reflection property with respect to the light emitted from the organic EL layer 52.

As described above, in the organic EL element $E_{i,j}$ which has the stacked structure, when a forward bias voltage is applied between the pixel electrode 51 and common electrode 53, the hole is implanted in the organic EL layer 52 from the pixel electrode 51, and the electron is implanted in the organic EL layer 52 from the common electrode 53. Moreover, the hole and electron are transported by the organic EL layer 52, the hole and electron are re-bonded in the organic EL layer 52 to generate the exciton, the exciton excites the organic EL layer 52, and the organic EL layer 52 emits the light.

Here, an emission luminance (unit cd/m$^2$) of the organic EL element $E_{i,j}$ depends on the current value of the current flowing through the organic EL element $E_{i,j}$. The emission luminance of the organic EL element $E_{i,j}$ is kept to be constant in an emission period of the organic EL element $E_{i,j}$, or the emission luminance is set in accordance with the current value of a gradation signal outputted from the data driver 3. For this purpose, the pixel circuit $D_{i,j}$ which controls the current value of the organic EL element $E_{i,j}$ is disposed around the organic EL element $E_{i,j}$ for each pixel $P_{i,j}$.

Each pixel circuit $D_{i,j}$ includes the first to third transistors 21, 22, 23 constituted of thin-film transistors (TFT) of a field effect type of an N channel MOS structure, and a capacitor 24.

Each first transistor 21 is a field-effect transistor of MOS type constituted of a gate electrode 21*g*, gate insulation film 42, semiconductor layer 43, source electrode 21*s*, and drain electrode 21*d*. Each second transistor 22 is a field-effect transistor of MOS type constituted of a gate electrode 22*g*, gate insulation film 42, semiconductor layer 43, source electrode 22*s*, and drain electrode 22*d*. Each third transistor 23 is constituted of a gate electrode 23*g*, gate insulation film 42, semiconductor layer 43, source electrode 23*s*, and drain electrode 23*d*.

Concretely, as shown in FIG. 3, the first transistor 21 is an inverse stagger type transistor including: the gate electrode 21*g* formed of aluminum disposed on the transparent substrate 8; the oxidation insulation film 41 constituted by anode-oxidizing aluminum disposed so as to coat the gate electrode 21*g*; the gate insulation film 42 formed of silicon nitride or silicon oxide with which the oxidation insulation film 41 is coated; the island-shaped semiconductor layer 43 formed on the gate insulation film 42; the channel protective insulation film 45 formed of silicon nitride formed on the semiconductor layer 43; impurity semiconductor layers 44, 44 disposed in opposite ends of the semiconductor layer 43 and film of $n^+$ silicon; and the source electrode 21*s* and drain electrode 21*d* selected from chromium, chromium alloy, aluminum, aluminum alloy formed on the impurity semiconductor layers 44, 44.

The second and third transistors 22 and 23 also have the same constitution as that of the first transistor 21, but a shape, size, dimension of each of the transistors 21, 22, 23, a channel width of the semiconductor layer 43, a channel length of the semiconductor layer 43, and the like are appropriately set in accordance with the functions of the transistors 21, 22, 23.

Moreover, the transistors 21, 22, 23 may simultaneously be formed in the same process. In this case, the transistors 21, 22, 23 have the same compositions of the gate electrode, oxidation insulation film 41, gate insulation film 42, semiconductor layer 43, impurity semiconductor layers 44, 44, source electrode, and drain electrode.

Even when the semiconductor layers 43 of the transistors 21, 22, 23 are amorphous silicon, sufficient driving is possible, but the semiconductor layer may also be poly-silicon or monocrystalline silicon. The structure of the transistors 21, 22, 23 is not limited to the inverse stagger type, and may also be of a stagger or coplanar type.

Each capacitor 24 is connected to an electrode 24A connected to the gate electrode 23*g* of each third transistor 23, an electrode 24B connected to the source electrode 23*s* of the transistor 23, and a dielectric including a part of the gate insulation film 42 disposed between the electrodes 24A and 24B, and accumulates electric charges between the source electrode 23*s* and drain electrode 23*d* of the transistor 23.

As shown in FIG. 6, in the respective second transistors 22 of pixel circuits $D_{i,1}$ to $D_{i,n}$ of the i-th row, the gate electrode 22*g* is connected to the selection scanning line $X_i$ of the i-th row, and the drain electrode 22*d* is connected to the power scanning line $Z_i$ of the i-th row. The drain electrode 23*d* of each third transistor 23 of the pixel circuits $D_{i,1}$ to $D_{i,n}$ Of the i-th row is connected to the power scanning line $Z_i$ of the i-th row. The gate electrode 21g of each first transistor 21 of the pixel circuits $D_{i,1}$ to $D_{i,n}$ of the i-th row is connected to the selection scanning line $X_i$ of the i-th row. The source electrode 21s of each first transistor 21 of pixel circuits D to $D_{m,j}$ of a j-th column is connected to the signal line $Y_j$ of the j-th column.

In the pixels $P_{1,1}$ to $P_{m,n}$, as shown in FIG. 4, the source electrode 22s of the second transistor 22 is connected to the gate electrode 23g of the third transistor 23 via a contact hole 25 formed in the gate insulation film 42, and connected to one electrode 24A of the capacitor 24. The source electrode 23s of the transistor 23 is connected to the other electrode 24B of the capacitor 24, and also connected to the drain electrode 21d of the transistor 21. Any of the source electrode 23s of the third transistor 23, the other electrode 24B of the capacitor 24, and the drain electrode 21d of the first transistor 21 is connected to the pixel electrode 51 of the organic EL element $E_{i,j}$. The voltage of the common electrode 53 of the organic EL element $E_{i,j}$ is a reference voltage $V_{ss}$. In the present embodiment, the common electrode 53 of all the organic EL elements $E_{1,1}$ to $E_{m,n}$ is grounded, and the reference voltage $V_{ss}$ is set to 0 [V].

Between the selection scanning line $X_i$ and signal line $Y_j$, and between the power scanning line $Z_i$ and signal line $Y_j$, in addition to the gate insulation film 42, a protective film 43A is formed and disposed by patterning the same film as that of the semiconductor layer 43 of each of the transistors 21 to 23.

As shown in FIGS. 1, 6, the selection scanning lines $X_1$ to $X_m$ are connected to the selection scanning driver 5, and the power scanning lines $Z_1$ to $Z_m$ are connected to the power scanning driver 6.

The selection scanning driver 5 is formed of a so-called shifter register. As a result, after a predetermined time (in detail, a reset period $T_{RESET}$ described later), the selection scanning driver 5 successively outputs a scanning signal to the selection scanning line $X_m$ from the selection scanning line $X_1$ in order based on a clock signal from the outside (scanning line $X_1$ next to the scanning line $X_m$), and the transistors 21, 22 of the scanning lines $X_1$ to $X_m$ are selected.

Figure 8:
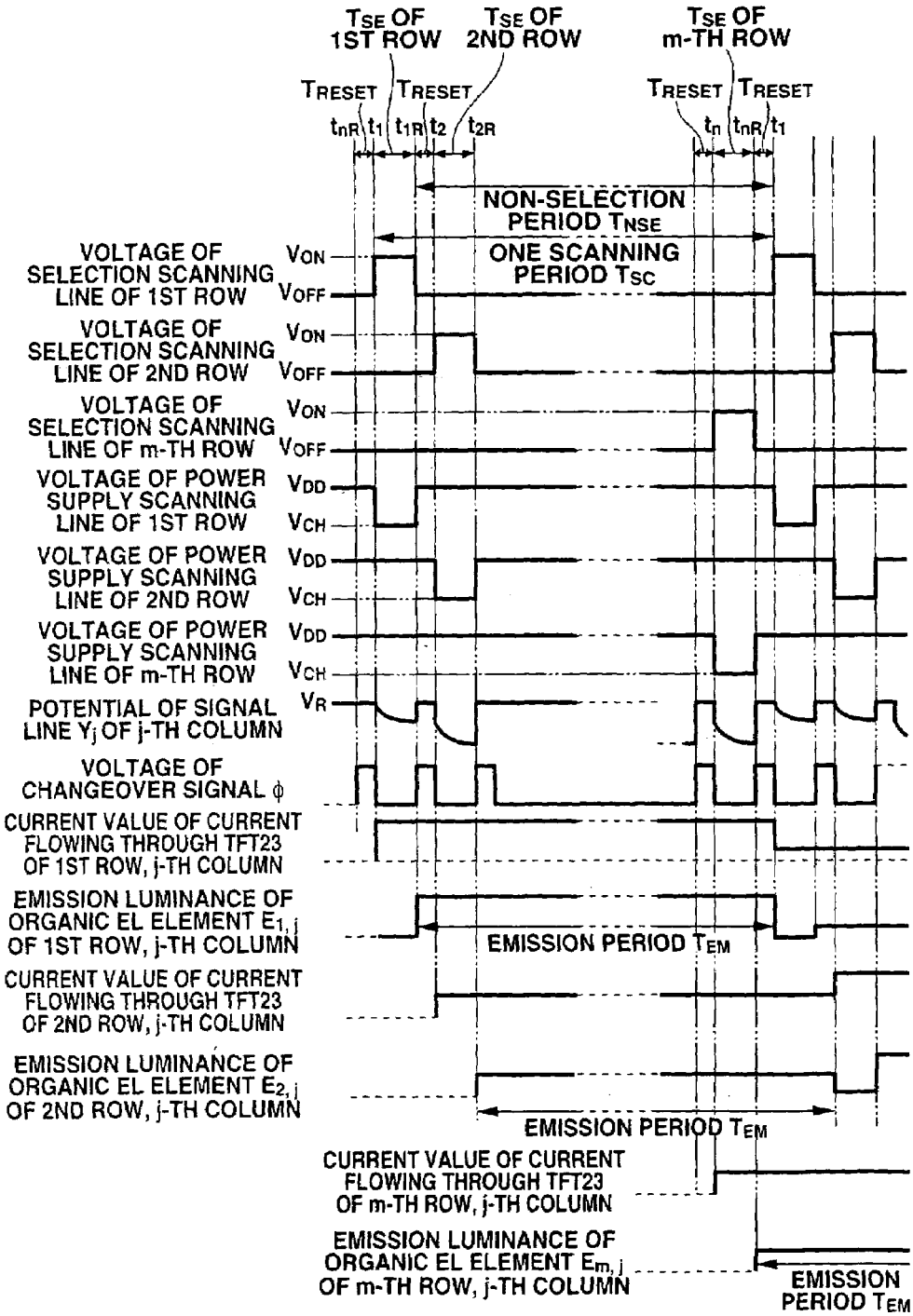
FIG. 8 is a timing chart of a signal in the display apparatus of FIG. 1.

In detail, as shown in FIG. 8, with respect to the selection scanning lines $X_1$ to $X_m$, the selection scanning driver 5 successively outputs an on-voltage $V_{on}$ (sufficiently higher than the reference voltage $V_{ss}$) of a high level, which brings the transistors 21 and 22 into the on state in each selection period $T_{SE}$, and outputs an off-voltage $V_{off}$ (not more than the reference voltage $V_{ss}$) of the low level which brings the transistors 21 and 22 into an off state in each non-selection period $T_{NSE}$. Here, in each of the selection scanning lines $X_1$ to $X_m$, the selection period and non-selection period are alternately repeated, and the selection periods of the selection scanning lines $X_1$ to $X_m$ are set not to overlap with one another. Therefore, a period represented by $T_{SE}+T_{NSE}=T_{SC}$ is one scanning period.

That is, in the selection period $T_{SE}$ in which any selection scanning line $X_i$ is selected from the selection scanning lines $X_1$ to $X_m$, when the selection scanning driver 5 outputs the pulse signal of the on-voltage $V_{on}$ to the selection scanning line $X_i$, the transistors 21, 22 connected to the selection scanning line $X_i$ are brought in the on state (all transistors 21, 22 of the pixel circuits $D_{i,1}$, $D_{i,2}$, $D_{i,3}$ . . . $D_{i,n}$). When the transistor 21 is in the on state, the current flowing through the signal line $Y_j$ can flow through the pixel circuit $D_{i,j}$. At this time, for the selection scanning lines $X_1$ to $X_m$, the respective transistors 21, 22 of the $X_1$ to $X_{i-1}$ $X_{i+1}$ to $X_m$ other than the selection scanning line $X_i$ are in the non-selection period $T_{NSE}$. Therefore, the off-voltage $V_{off}$ is outputted and both the transistors 21, 22 are in the off state. When the transistors 21, 22 are in the off state in this manner, the current flowing through the signal line $Y_j$ cannot flow through the pixel circuit $D_{i,j}$.

Here, the selection period $T_{SE}$ of the i-th row does not continue to that of the (i+1)-st row, and a reset period $T_{RESET}$ shorter than the selection period $T_{SE}$ exists between the selection periods $T_{SE}$ of the i-th row and the (i+1)-st row. That is, after elapse of the reset period $T_{RESET}$ after the pulse signal of the on-voltage $V_{on}$ is completely outputted to the selection scanning line $X_i$ of the i-th row, the selection scanning driver 5 outputs the pulse signal of the on-voltage $V_{on}$ to the selection scanning line $X_{i+1}$ of the (i+1)-th row. Accordingly, after the elapse of the reset period $T_{RESET}$ after the completion of the selection of the i-th row, the i+1-st row is selected.

The details will be described later. In each selection period $T_{SE}$ in which the selection scanning lines $X_1$ to $X_m$ are selected, when the data driver 3 appropriately passes the current through current terminals $OT_1$ to $OT_n$, a gradation designating current appropriately flows through the signal lines $Y_1$ to $Y_n$ along a direction shown by an arrow of FIG. 6. Here, the gradation designating current is the sink current flowing to the data driver 3 from the signal lines $Y_1$ to $Y_n$ via the current terminals $OT_1$ to $Ot_n$, and is equal to the current value of the current flowing through the organic EL elements $E_{1,1}$ to $E_{m,n}$ in order to emit the light at the luminance gradation in accordance with image data.

The power scanning driver 6 shown in FIG. 1 is constituted of the so-called shift register. The power scanning driver 6 successively applies a predetermined source/drain voltage to the transistor 23 connected to the power scanning lines $Z_1$ to $Z_m$ in synchronization with the selection scanning driver 5. The power scanning driver 6 successively outputs the pulse signal to the power scanning line $Z_m$ from the power scanning lines $Z_1$ in order (the power scanning line $Z_1$ next to the power scanning line $Z_m$) based on the clock signal from the outside in synchronization with the pulse signal of the on-voltage $V_{on}$ of the same row of the selection scanning driver 5. Accordingly, after the reset period $T_{RESET}$, the predetermined voltage is successively applied to the power scanning lines $Z_1$ to $Z_m$.

In detail, as shown in FIG. 8, the power scanning driver 6 applies a charge voltage $V_{CH}$ of the low level (potential equal to or less than the reference voltage $V_{ss}$) to each power scanning line $Z_i$ in a predetermined period. That is, in the selection period $T_{SE}$ in which each selection scanning line $X_i$ is selected, the power scanning driver 6 applies the charge voltage $V_{CH}$ of the low level to the power scanning line $Z_i$ so that the gradation designating current flows between the source and drain of the third transistor 23. On the other hand, in the non-selection period $T_{NSE}$, the power scanning driver 6 applies a power voltage $V_{DD}$ of a level higher than that of the charge voltage $V_{CH}$ to the power scanning line $Z_i$ so that the driving current flows between the source and drain of the transistor 23. The power voltage $V_{DD}$ is higher than the reference voltage $V_{ss}$ and reset voltage $V_R$, and the third transistor 23 obtains the on state. At this time, when the first transistor 21 is in the off state, the current flows to the organic EL element $E_{i,j}$ from the power scanning line $Z_i$.

Figure 7:
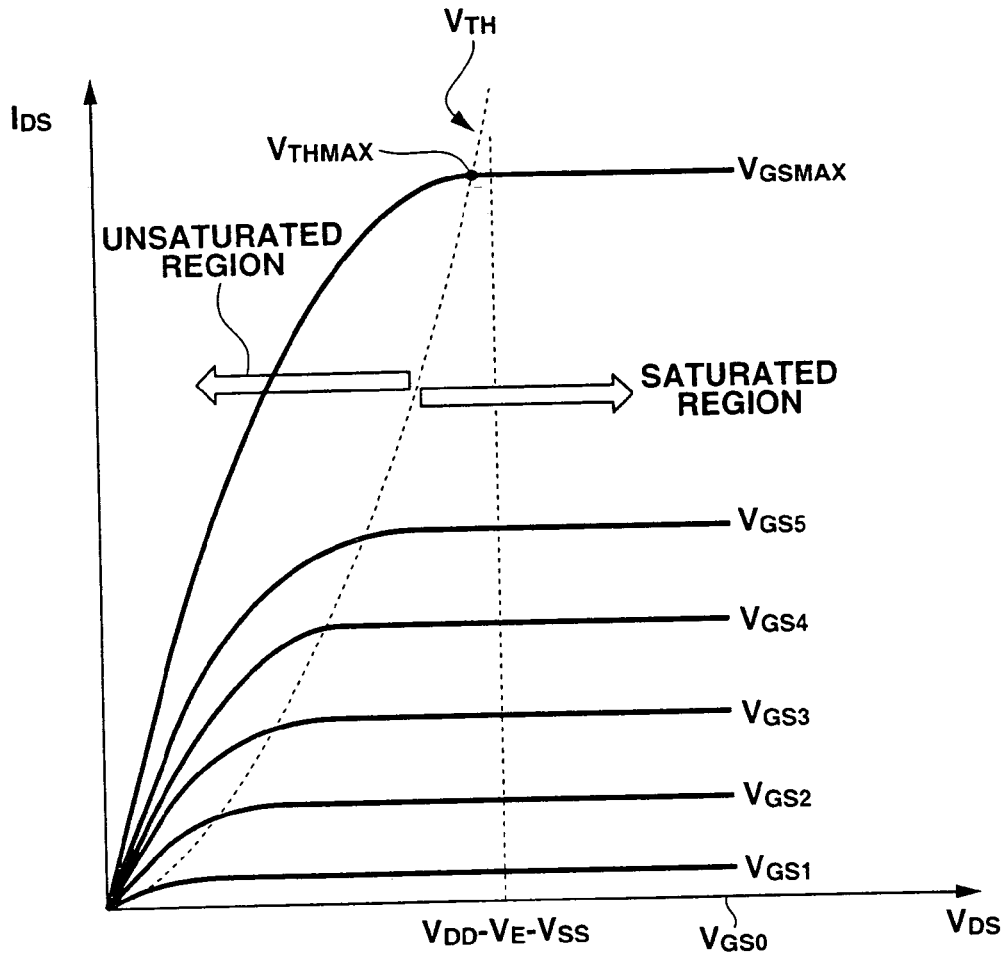
FIG. 7 is a diagram showing current/voltage characteristics of a field-effect transistor of an N channel type.

Next, the power voltage $V_{DD}$ will be described. FIG. 7 is a graph showing current/voltage characteristics of the field-effect transistor 23 of the N channel type. In FIG. 7, the abscissa shows a drain/source voltage $V_{DS}$, and the ordinates shows a current value $I_{DS}$ of the current between the drain and source. In a shown unsaturated region (drain/source voltage $V_{DS}$<drain saturated threshold voltage $V_{TH}$: the drain saturated threshold voltage $V_{TH}$ follows a gate/source voltage $V_{GS}$), when the gate/source voltage $V_{GS}$ is constant and the source/drain voltage $V_{DS}$ rises, the current value $I_{DS}$ of the current between the source and drain increases. Furthermore, in the shown saturated region (source/drain voltage $V_{DS} \geqq$ drain saturated threshold voltage $V_{TH}$), when the gate/source voltage $V_{GS}$ is constant, and even when the source/drain voltage $V_{DS}$ increases, the current value $I_{DS}$ of the current flowing between the source and drain is substantially constant.

Moreover, in FIG. 7, gate/source voltages $V_{GS0}$ to $V_{GSMAX}$ have a relation of $V_{GS0}=0<V_{GS1}<V_{GS2}<V_{GS3}<V_{GS4}<V_{GS5}< \ldots <V_{GSMAX}$. As apparent from FIG. 7, when the drain/source voltage $V_{DS}$ is constant, and when the gate/source voltage $V_{GS}$ increases, the current value $I_{DS}$ of the drain/source current increases in either the unsaturated region and saturated region. Furthermore, when the gate/source voltage $V_{GS}$ increases, the drain saturated threshold voltage $V_{TH}$ increases.

As described above, in the unsaturated region, even when the drain/source voltage $V_{DS}$ slightly changes, the current value $I_{DS}$ of the source/drain current changes. However, in the saturated region, when the gate/source voltage $V_{GS}$ is determined, the current value $I_{DS}$ of the drain/source current is uniquely determined irrespective of the source/drain voltage $V_{DS}$.

Here, the current value $I_{DS}$ of the drain/source current at a time when the maximum gate/source voltage $V_{GSMAX}$ is applied to the third transistor 23 is set to the current value of the current flowing between the pixel electrode 51 and common electrode 53 of the organic EL element $E_{i,j}$ which emits the light at the maximum luminance.

Even when the gate/source voltage $V_{GS}$ of the third transistor 23 is maximum $V_{GSMAX}$, the following condition equation (1) is preferably satisfied so that the transistor 23 maintains the saturated region.

$$V_{DD}-V_E-V_{SS} \geqq V_{THMAX} \quad (1),$$

where $V_E$ is a predicted maximum voltage divided into the organic EL element $E_{i,j}$ at a maximum luminance time, which gradually increases for high resistance of the organic EL element $E_{i,j}$ in an emission life period of the organic EL element $E_{i,j}$, and $V_{THMAX}$ is a saturated threshold voltage between the source and drain of the third transistor 23 at a time of $V_{GSMAX}$. The power voltage $V_{DD}$ is determined so as to satisfy the above condition equation.

As shown in FIG. 1, the signal lines $Y_1$ to $Y_n$ are connected to the current/voltage switch portion 7. The current/voltage switch portion 7 is constituted of switch circuits $S_1$ to $S_n$, and the signal lines $Y_1$ to $Y_n$ are connected to the switch circuits $S_1$ to $S_n$, respectively. Furthermore, the current terminals $OT_1$ to $OT_n$ of the data driver 3 are connected to the switch circuits $S_1$ to $S_n$. The switch circuits $S_1$ to $S_n$ are connected to a switch-signal input terminal 140, and a switch signal $\phi$ is inputted into the switch circuits $S_1$ to $S_n$ as shown by an arrow. The switch circuits $S_1$ to $S_n$ are connected to a reset voltage input terminal 141, and the reset voltage $V_R$ is applied to the switch circuits $S_1$ to $S_n$ via this terminal.

The reset voltage $V_R$ is set to a voltage higher than a highest gradation voltage Vhsb. This highest gradation voltage Vhsb is a voltage V set to be stationary in accordance with the electric charges charged in the signal lines $Y_1$ to $Y_n$ by the gradation designating current having a current value equal to that of a maximum gradation driving current $I_{MAX}$ flowing through the organic EL elements $E_{1,1}$ to $E_{m,n}$, when the organic EL elements $E_{1,1}$ to $E_{m,n}$ emit the light at a brightest maximum gradation luminance $I_{MAX}$ in the selection period $T_{SE}$. The reset voltage $V_R$ is preferably not less than an intermediate voltage which has an intermediate value between a lowest gradation voltage Vlsb set to be stationary in accordance with the electric charges charged in the signal lines $Y_1$ to $Y_n$ by the gradation designating current having a current value equal to that of a minimum gradation driving current $I_{MIN}$ flowing through the organic EL elements $E_{1,1}$ to $E_{m,n}$, when each of the organic EL elements $E_{1,1}$ to $E_{m,n}$ has a minimum gradation luminance $L_{MIN}$ (additionally, the current value of the current exceeds 0 A), and the highest gradation voltage Vhsb, more preferably a value equal to or more than the lowest gradation voltage Vlsb, most preferably a voltage equal to the charge voltage $V_{CH}$.

A switch circuit $S_j$ (the switch circuit $S_j$ is connected to the signal line $Y_j$ of the j-th column) switches to either one of the passing of the current through the signal line $Y_j$ in accordance with the signal from the current terminal $OT_j$ of the data driver 3 and the outputting of the reset voltage $V_R$ of a predetermined voltage level from the reset voltage input terminal 141 to the signal line $Y_j$. That is, when the switch signal $\phi$ inputted into the switch circuit $S_j$ from the switch signal input terminal 140 is of a high level, the switch circuit $S_j$ cuts the sink current of the current terminal $OT_j$, and outputs the reset voltage from the reset voltage input terminal 141 to the signal line $Y_j$. On the other hand, when the switch signal $\phi$ inputted into the switch circuit $S_j$ from the switch signal input terminal 140 is of a low level, the switch circuit $S_j$ passes the sink current between the current terminal $OT_j$ and signal line $Y_j$, and cuts the reset voltage $V_R$ from the reset voltage input terminal 141.

In this manner, when the source/drain voltage of the third transistor 23 is set to be a high voltage in the saturated region shown in FIG. 7, the current value of the gradation designating current flowing through the signal line $Y_j$ is determined by the gate/source voltage of the transistor 23. That is, when the gate voltage of the transistor 23 is sufficiently higher than the source voltage, the gradation designating current flowing between source and drain of the transistor 23 and through the signal line $Y_j$ becomes large. When the gate voltage of the transistor 23 is not very higher than the source voltage, a small current is obtained.

Here, a display apparatus is considered assuming that the current/voltage switch portion 7 of the present invention is not disposed and the data driver 3 derives the current directly from the signal line $Y_j$.

In the pixel $P_{i,j}$ of the i-th row and j-th column, in the selection period of the i-th row, the second transistor 22 connected to the selection scanning line $X_i$ is brought in the on state. Accordingly, the charge voltage $V_{CH}$ is applied to the gate of the third transistor 23 from the power scanning line $Z_i$, and the electric charges are charged into the capacitor 24 from one electrode 24A side of the third transistor 23. That is, the gate voltage of the transistor 23 of the selection period is always substantially constant at the charge voltage $V_{CH}$. At this time, the potential of the source 23*s* of the transistor 23 is equal to that of the signal line $Y_j$ because the transistor 21 is in the on state. The potential of the signal line $Y_j$ is controlled by the data driver 3. Moreover, the data driver 3 forcibly passes the gradation designating current having the predetermined current value between the source and drain of the transistor 23. Therefore, when the current value of the gradation designating current is large, the gate/source voltage of the transistor 23 is high, and therefore the potential of the signal line $Y_j$ is relatively lower.

Figure 9A:
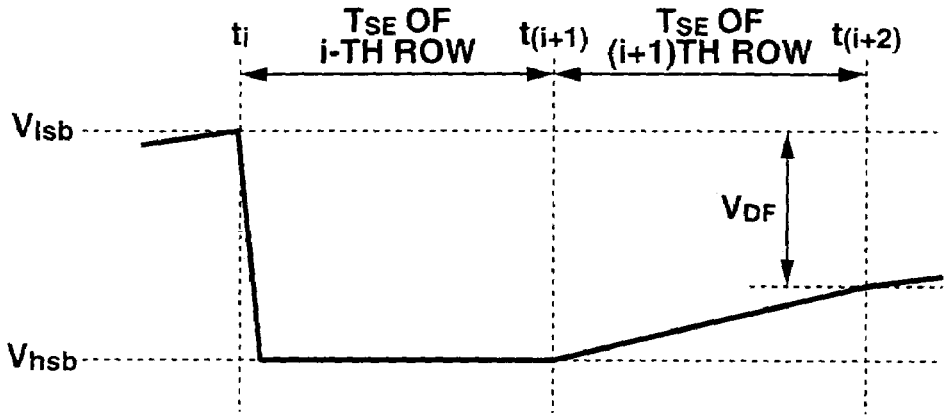
FIG. 9A is a diagram showing the voltage of the current flowing through a signal line in the display apparatus of a comparative example in which a current/voltage changeover portion is removed from the display apparatus of the present invention.

More concretely, as shown in FIG. 9A, when the sink current having the maximum current value is passed through the signal line $Y_j$ in the selection period $T_{SE}$ of the i-th row in order to emit the light from the organic EL element $E_{i,j}$ of the pixel $P_{i,j}$ at the maximum gradation (maximum luminance), the highest gradation voltage Vhsb applied to the signal line $Y_j$ at a time when the electric charges meeting the current value of the current are charged in the other electrode 24B of the capacitor 24 is relatively sufficiently lower than the reference voltage $V_{ss}$ or the charge voltage $V_{CH}$.

Moreover, when the sink current (additionally, not non-current) having the minimum current value is passed through the signal line $Y_j$ in order to emit the light from the organic EL element $E_{i+1,j}$ of the pixel $P_{i+1,j}$ of the next (i+1)st row at the minimum gradation luminance (minimum luminance), the lowest gradation voltage Vlsb has to be set in order to charge the electric charges meeting the current value of the current in the capacitor 24. The lowest gradation voltage Vlsb is approximate to the charge voltage $V_{CH}$ so that the gate/source voltage of the third transistor 23 is low, and is sufficiently higher than the highest gradation voltage Vhsb. However, since the current value of the minimum gradation designating current flowing through the signal line $Y_j$ is remarkably small, the potential difference of the signal line $Y_j$ displaced in a unit time is small. Therefore, much time is required from when the capacitor 24 is charged up until the potential of the signal line $Y_j$ is set to be stationary at the lowest gradation voltage Vlsb from the highest gradation voltage Vhsb. Especially, when the number of rows of the display apparatuses is large with the increase in the number of pixels, the selection period $T_{SE}$ has to be set to be short. Without reaching the lowest gradation voltage Vlsb, a difference of a voltage $V_{DF}$ is generated, and the organic EL element $E_{i+1,j}$ of the pixel $P_{i+1,j}$ cannot emit the light at an exact luminance.

Figure 9B:
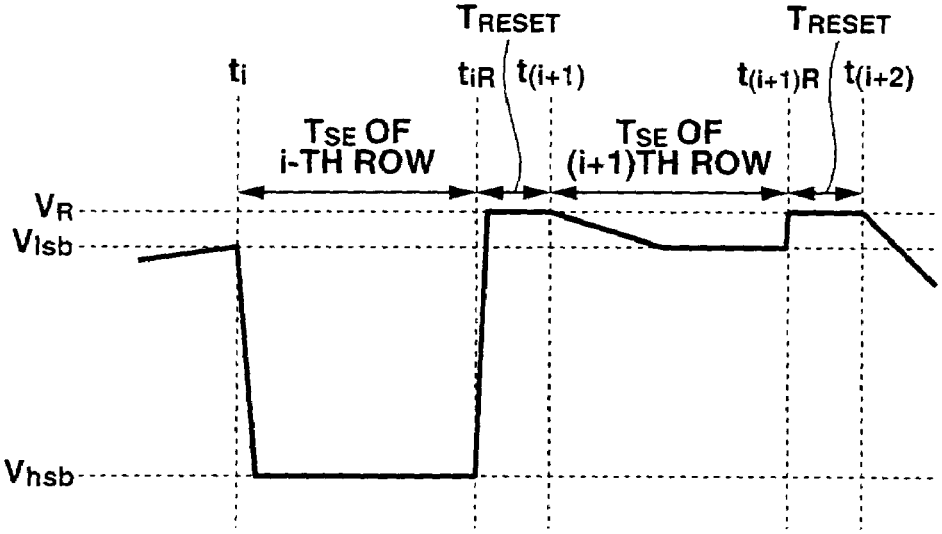
FIG. 9B is a diagram showing the voltage of the current flowing through the signal line in the display apparatus of the present invention.

On the other hand, since the current/voltage switch portion 7 is disposed in the display apparatus 1 of the present embodiment, as shown in FIG. 9B, in the reset period $T_{RESET}$, the switch circuit $S_j$ forcibly switches the potential of the signal line $Y_j$ to the reset voltage $V_R$ sufficiently higher than the highest gradation voltage Vhsb. Therefore, even when the lowest gradation designating current having a micro current value is passed through the signal line $Y_j$ in the selection period $T_{SE}$, the capacitor 24 is quickly charged and the signal line $Y_j$ can be set to be stationary at the lowest gradation voltage Vlsb.

Next, one example of the switch circuit $S_j$ will be described. The switch circuit $S_j$ is constituted of a fourth transistor 31 which is the field-effect transistor of the P channel type, and a fifth transistor 32 which is the field-effect transistor of the N channel type. The gate electrodes of the fourth and fifth transistors 31, 32 are connected to the switch signal input terminal 140. The source electrode of the fourth transistor 31 is connected to the signal line $Y_j$, and the drain electrode is connected to the current terminal $OT_j$. The drain electrode of the fifth transistor 32 is connected to the signal line $Y_j$, and the source electrode is connected to the reset voltage input terminal 141. In this constitution, when the switch signal ϕ from the switch signal input terminal 140 is of the high level, the fifth transistor 32 obtains the on state, and the fourth transistor 31 obtains the off state. On the other hand, when the switch signal ϕ from the switch signal input terminal 140 is of the low level, the fourth transistor 31 obtains the on state, and the fifth transistor 32 obtains the off state. Different from this embodiment, the fourth transistor 31 is set to be of the P channel type, the fifth transistor 32 is set to be of the N channel type, and the high/low level of the switch signal ϕ may be brought in a reverse phase to change over the switching of the switch circuit $S_j$.

Here, a period of the switch signal ϕ inputted into the switch signal input terminal 140 will be described. When the selection scanning driver 5 applies the on-voltage $V_{on}$ to any of the selection scanning lines $X_1$ to $X_m$ as shown in FIG. 8, the switch signal ϕ inputted into the switch signal input terminal 140 is of the low level. On the other hand, when the selection scanning driver 5 applies the off-voltage $V_{off}$ to all the selection scanning lines $X_1$ to $X_m$, that is, in the reset period $T_{RESET}$ in any of the first to m-th rows, the switch signal ϕ inputted into the switch signal input terminal 140 has the high level. For example, the reset period $T_{RESET}$ in which the potential of the signal lines $Y_1$ to $Y_n$ by the sink current of the i-th row is set to the reset voltage $V_R$ is between an end time $t_{iR}$ of the selection period $T_{SE}$ of the i-th row and a start time $t+_1$ of the selection period $T_{SE}$ of the next (i+1)st row. That is, the switch signal ϕ inputted into the switch signal input terminal 140 obtains the high level every n reset periods $T_{RESET}$ in one scanning period $T_{SC}$. This switch signal ϕ may also have the same frequency as that of the clock signal inputted from the outside.

The data driver 3 passes the gradation designating current to the current terminals $OT_1$ to $OT_n$ by the clock signal from the outside. When the switch signal ϕ inputted into the switch signal input terminal 140 is of the low level, the data driver 3 synchronously takes the gradation designating current into all the current terminals $OT_1$ to $OT_n$. When the switch signal ϕ inputted into the switch signal input terminal 140 is of the high level, the data driver 3 does not take the gradation designating current from any of the current terminals $OT_1$ to $OT_n$.

Therefore, in the selection period $T_{SE}$ of each row, the gradation designating current flows into the current terminals $OT_1$ to $OT_n$ from the signal lines $Y_1$ to $Y_n$, On the other hand, in the reset period $T_{RESET}$ of each row, the reset voltage $V_R$ is applied to the signal lines $Y_1$ to $Y_n$ to obtain the stationary state.

Next, the gradation designating current of the data driver 3 will be described in detail. In the selection period $T_{SE}$ of each row, the data driver 3 generates the gradation designating current toward the respective current terminals $OT_1$ to $OT_n$ from the power scanning lines $Z_1$ to $Z_m$ which output the charge voltage $V_{CH}$ through the third transistor 23, first transistor 21, signal lines $Y_1$ to $Y_n$, and switch circuits $S_1$ to $S_n$. The current value of the gradation designating current has the level in accordance with the image data. That is, the current value of the gradation designating current is equal to that of the current flowing through the organic EL elements $E_{1,1}$ to $E_{m,n}$ in order to emit the light at the luminance gradation in accordance with the image data.

Next, the display operation and driving method of the display apparatus 1 constituted as described above will be described.

As shown in FIG. 8, the selection scanning driver 5 successively outputs the pulse signal of the on-voltage $V_{on}$ (high level) to the selection scanning line $X_m$ of the m-th row from the selection scanning line $X_1$ of the first row based on the inputted clock signal. Moreover, the power scanning driver 6 successively outputs the pulse signal of the charge voltage $V_{CH}$ (low level) to the power scanning line $Z_m$ of the m-th row from the power scanning line $Z_1$ of the first row based on the inputted clock signal. In the selection period $T_{SE}$ of each row, the data driver 3 takes the gradation designating current into the switch circuits $S_1$ to $S_n$ from all the current terminals $OT_1$ to $OT_n$ based on the clock signal.

Moreover, since the switch signal ϕ inputted into the switch signal input terminal 140 has the low level in the selection period $T_{SE}$ of each row, the fourth transistors 31 of the switch circuits $S_1$ to $S_n$ obtain the on state, and the fifth transistors 32 obtain the off state. On the other hand, since the switch signal ϕ inputted into the switch signal input terminal has the high level in the reset period $T_{RESET}$ of each row, the fourth transistors 31 of the switch circuits $S_1$ to $S_n$ obtain the off state, and the fifth transistors 32 obtain the on state. That is, when the current/voltage switch portion 7 disconnects the signal lines $Y_1$ to $Y_n$ from the reset voltage input terminal 141 in the selection period $T_{SE}$ of each row, the portion is to pass the gradation designating current equal to the current value of the current flowing through the organic EL elements $E_{1,1}$ to $E_{m,n}$ in order to emit the light at the luminance gradation in accordance with the image data. The portion further functions not to apply the reset voltage $V_R$ to the signal lines $Y_1$ to $Y_n$. On the other hand, in the reset period $T_{RESET}$ of each row, the current/voltage switch portion 7 disconnects the signal lines $Y_1$ to $Y_n$ from the current terminals $OT_1$ to $OT_n$, and connects the signal lines $Y_1$ to $Y_n$ to the reset voltage input terminal 141. Accordingly, the portion functions so as to quickly set the potential of each of the signal lines $Y_1$ to $Y_n$ to the reset voltage $V_R$.

Here, a timing at which the on-voltage $V_{on}$ is outputted to the selection scanning line $X_i$ substantially agrees with that at which the charge voltage $V_{CH}$ is outputted to the power scanning line $Z_i$, a time length of the on-voltage $V_{on}$ is substantially the same as that of the charge voltage $V_{CH}$, and the pulse signal is outputted between the time $t_i$ to time $t_{iR}$ (this period is the selection period $T_{SE}$ of the i-th row). That is, the period in which the on-voltage $V_{on}$ outputted from the selection scanning driver 5 shifts is synchronized with that in which the charge voltage $V_{CH}$ outputted from the power scanning driver 6. When the pulse signal of the on level is outputted to the selection scanning line $X_i$, the switch signal $\phi$ inputted into the switch signal input terminal 140 has the low level, and therefore the transistor 31 obtains the on state.

Since the charge voltage $V_{CH}$ outputted to the power scanning line $Z_i$ is not more than the reference voltage $V_{ss}$ in the selection period $T_{SE}$, the gradation designating current does not flow through the organic EL elements $E_{i,1}$ to $E_{i,n}$. Therefore, the gradation designating current of the current value meeting the gradation flows through the data driver 3 from the transistor 23. Therefore, the electric charges are written in the capacitor 24 so as to maintain the exact voltage between the gate and source of the transistor 23, which is required for the third transistor 23 to pass the gradation designating current. As a result, the transistor 23 can continuously pass the driving current of the current value equal to that of the gradation designating current even in an emission period $T_{EM}$. Since the transistor 21 has the off state in the emission period $T_{EM}$, this driving current does not flow through the signal lines $Y_1$ to $Y_n$, and flows through the organic EL elements $E_{i,1}$ to $E_{i,n}$, and current control of a precise luminance gradation is possible.

As described above, when the selection scanning driver 5 and power scanning driver 6 linearly successively shift the pulse signal to the m-th row from the first row, the pixels $P_{1,1}$ to $P_{1,n}$ of the first row to the pixels $P_{m,1}$ to $P_{m,n}$ of the m-th row are successively updated based on the gradation designating current of the data driver 3. When this linearly successive scanning is repeated, the display portion 4 of the organic EL display panel 2 displays the image.

Here, the update of the pixels $P_{i,1}$ to $P_{i,n}$ of the selected i-th row in one scanning period $T_{SC}$, and the gradation representation of the pixels $P_{i,1}$ to $P_{i,n}$ of the selected i-th row will be described.

In the selection period $T_{SE}$ of the i-th row, when the selection scanning driver 5 outputs the pulse signal of the high level to the selection scanning line $X_i$ of the i-th row, the transistors 21 and 22 of all the pixel circuits $D_{i,1}$ to $D_{i,n}$ connected to the selection scanning line $X_i$ obtain the on state in the selection period $T_{SE}$. Furthermore, in the selection period $T_{SE}$ of the i-th row, the power scanning driver 6 applies the pulse signal of the low level as the charge voltage $V_{CH}$ which is the same as or lower than the reference voltage $V_{ss}$ to the power scanning line $Z_i$ of the i-th row. At this time, since the transistor 22 has the on state, the voltage is also applied to the gate electrode 23*g* of the third transistor 23, and the third transistor 23 obtains the on state.

On the other hand, since the switch signal $\phi$ inputted into the switch signal input terminal 140 has the low level in the selection period $T_{SE}$ of the i-th row, the transistors 31 of all the switch circuits $S_1$ to $S_n$ have the on state, and the transistors 32 have the off state. Furthermore, in accordance with the image data inputted into the data driver 3 in the selection period of the i-th row, in all the pixel circuits $D_{i,1}$ to $D_{i,n}$ of the i-th row, the gradation designating current flows through the data driver 3 set to the relatively low voltage so that the gradation designating current flows through the power scanning line $Z_i$ to which the charge voltage $V_{CH}$ of the relatively high voltage is applied→third transistor 23→first transistor 21→fourth transistor 31. At this time, the source/drain current of the third transistor 23 has the current value of the gradation designating current and the voltage between the gate and source of the transistor 23 obtains the current value of the gradation designating current flowing between the source and drain of the transistor 23 in the emission period $T_{EM}$. To obtain this voltage, the electric charges are charged in the capacitor 24.

In this manner, in the selection period $T_{SE}$ of the i-th row, the gradation designating current having a constant level is forcibly passed through the power scanning line $Z_i$→the third transistors 23 of the pixel circuits $D_{i,1}$ to $D_{i,n}$→the first transistors 21 of the pixel circuits $D_{i,1}$ to $D_{i,n}$→the signal lines $Y_1$ to $Y_n$→the fourth transistors 31 of the switch circuits $S_1$ to $S_n$→the current terminals $OT_1$ to $OT_n$ of the data driver 3. Accordingly, in the selection period $T_{SE}$ of the i-th row, the voltages in the power scanning line $Z_i$, the transistors 23 of the pixel circuits $D_{i,1}$ to $D_{i,n}$, the transistors 21 of the pixel circuits $D_{i,1}$ to $D_{i,n}$, the signal lines $Y_1$ to $Y_n$, the transistors 31 of the switch circuits $S_1$ to $S_n$, and the current terminals $OT_1$ to $OT_n$ of the data driver 3 obtain the stationary state. Moreover, in any column of the first to n-th columns, the current value of the driving current flowing through the organic EL elements $E_{i,1}$ to $E_{i,n}$ in the emission period $T_{EM}$ reaches the current value of the gradation designating current flowing through the signal lines $Y_1$ to $Y_n$.

That is, the gradation designating current flows through the transistor 23, and the voltage in the power scanning line $Z_i$→ the transistors 23 of the pixel circuits $D_{i,1}$ to $D_{i,n}$ → the transistors 21 of the pixel circuits $D_{i,1}$ to $D_{i,n}$ → the signal lines $Y_1$ to $Y_n$ →the transistors 31 of the switch circuits $S_1$ to $S_n$ →the current terminals $OT_1$ to $OT_n$ of the data driver 3 obtains the stationary state. Accordingly, the voltage of the level in accordance with the current value of the gradation designating current flowing through the transistor 23 is applied between the gate electrode 23*g* and source electrode 23*s* of the transistor 23, and the electric charges having a size in accordance with the level of the voltage between the gate electrode 23*g* and source electrode 23*s* of the transistor 23 is charged in the capacitor 24. In other words, in the selection period $T_{SE}$ of the i-th row, in the pixel circuits $D_{i,1}$ to $D_{i,n}$ of the i-th row, the transistors 21 and 22 function to pass the gradation designating currents flowing through the signal lines $Y_1$ to $Y_n$ through the transistors 23, the transistors 23 function to obtain the gate/source voltage in accordance with the current value of the forcibly flowing gradation designating current, and the capacitor 24 functions so as to hold the level of the gate/source voltage.

Here, in each current flowing path through the power scanning line $Z_i$ through which the gradation designating current flows, the transistors 23 of the pixel circuits $D_{i,1}$ to $D_{i,n}$, the transistors 21 of the pixel circuits $D_{i,1}$ to $D_{i,n}$, the signal lines $Y_1$ to $Y_n$, the transistors 31 of the switch circuits $S_1$ to $S_n$, and the current terminals $OT_1$ to $OT_n$ of the data driver 3, assuming that an electrostatic capacity of the current path to each of the signal lines $Y_1$ to $Y_n$ from the source electrode 23*s* of each transistor 23 is C, electric charges Q charged in each current path at a voltage v are as follows:

$$Q=Cv \quad (2); \text{ and}$$

$$dQ=C\cdot dv \quad (3).$$

Assuming that the current value of the gradation designating current of the predetermined pixel $P_{i,j}$ is $I_{data}$ ($I_{data}$ is constant in the selection period $T_{SE}$), for a time dt required for bringing the voltage in the power scanning line $Z_i$, the third transistor 23 of the pixel circuit $D_{i,j}$, the first transistor 21 of the pixel circuit $D_{i,j}$, the signal line $Y_j$, the fourth transistor 31 of the switch circuit $S_j$, and the current terminal $OT_j$ of the data driver 3 into the stationary state, the following equation is established:

$$dt=dQ/I_{data} \quad (4),$$

where dQ denotes a change amount of the electric charge of the current path in the time dt, and also denotes the change amount of the electric charge of the signal line $Y_j$ in the potential difference dv. As described above, as $I_{data}$ decreases, dt lengthens. As dQ increases, dt lengthens.

As described above, in the selection period $T_{SE}$ of the i-th row, the sizes of the electric charges charged in the capacitors 24 of the pixel circuits $D_{i,1}$ to $D_{i,n}$ of the i-th row are updated from the previous one scanning period $T_{SC}$, and the current values of the driving currents flowing through the transistors 23 of the pixel circuits $D_{i,1}$ to $D_{i,n}$ Of the i-th row are updated from the previous scanning period $T_{SC}$.

Here, the potential in the arbitrary point in the transistor 23→the first transistor 21→the signal line $Y_j$ changes with internal resistances of the transistors 21, 22, 23 which change with the elapse of time. However, in the present embodiment, for the current value of the gradation designating current flowing through the transistor 23→the transistor 21→the signal line $Y_j$, even when the internal resistances of the transistors 21, 22, 23 change with the elapse of time, the current value of the gradation designating current flowing through the transistor 23→the transistor 21→the signal line $Y_j$ is as desired.

Moreover, in the selection period $T_{SE}$ Of the i-th row, the common electrode of the organic EL elements $E_{i,1}$ to $E_{i,n}$ of the i-th row is the reference voltage $V_{ss}$. The charge voltage $V_{CH}$ the same as or lower than the reference voltage $V_{ss}$ is applied to the power scanning line $Z_i$, therefore reverse bias voltages are applied to the organic EL elements $E_{i,1}$ to $E_{i,n}$ of the i-th row, the current does not flow through the organic EL elements $E_{i,1}$ to $E_{i,n}$ of the i-th row, and the organic EL elements $E_{i,1}$ to $E_{i,n}$ do not emit the light. Moreover, by the gradation designating current flowing through the signal lines $Y_1$ to $Y_n$, the signal lines $Y_1$ to $Y_n$ become stationary at a voltage lower than the charge voltage $V_{CH}$. The charges to the capacitors 24 for passing the driving current through the organic EL elements $E_{i,1}$ to $E_{i,n}$ are uniquely determined by the gradation designating current flowing through the data driver 3 from the signal lines $Y_1$ to $Y_n$.

Subsequently, in the end time $t_{1R}$ of the selection period $T_{SE}$ of the i-th row (i.e., the start time of the non-selection period $T_{NSE}$ of the i-th row), the selection scanning driver 5 ends the output of the pulse signal of the high level to the selection scanning line $X_i$, and the power scanning driver 6 ends the output of the pulse signal of the low level to the power scanning line $Z_i$. That is, in the non-selection period $T_{NSE}$ till a start time $t_1$ of the next selection period $T_{SE}$ Of the i-th row from an end time $t_2$, the off-voltage $V_{off}$ is applied to the gate electrodes 21*g* of the transistors 21 and the gate electrodes 22*g* of the transistors 22 of the pixel circuits $D_{i,1}$ to $D_{i,n}$ of the i-th row by the selection scanning driver 5, and the power voltage $V_{DD}$ is applied to the power scanning line $Z_i$ by the power scanning driver 6.

Therefore, in the non-selection period $T_{NSE}$ of the i-th row, the transistors 21 of the pixel circuits $D_{i,1}$ to $D_{i,n}$ of the i-th row obtain the off state, and the gradation designating current flowing through the signal lines $Y_1$ to $Y_n$ from the power scanning line $Z_i$ is cut. Furthermore, in the non-selection period $T_{NSE}$ of the i-th row, in any of the pixel circuits $D_{i,1}$ to $D_{i,n}$ of the i-th row, the second transistor 22 obtains the off state. The electric charges charged in the capacitor 24 in the previous selection period $T_{SE}$ of the i-th row are confined by the transistors 21 and 22. That is, in the non-selection period $T_{NSE}$ and the previous selection period $T_{SE}$, the gate/source voltages $V_{GS}$ of the third transistor 23 become equal. Therefore, between the gate and source of the transistor 23, the voltage for passing the current having the current value equal to that of the gradation current flowing in the selection period $T_{SE}$ continues to be applied even over the non-selection period $T_{NSE}$.

In the non-selection period $T_{NSE}$ of the i-th row, since the $V_{DD}$ satisfying the above condition equation (1) is applied from the power scanning line $Z_i$, the third transistors 23 of the pixel circuits $D_{i,1}$ to $D_{i,n}$ of the i-th row continuously pass the same driving current as the gradation designating current in the previous selection period $T_{SE}$. Moreover, in the non-selection period $T_{NSE}$ of the i-th row, the common electrode of the organic EL elements $E_{i,1}$ to $E_{i,n}$ of the i-th row has the reference voltage $V_{ss}$. Moreover, the power scanning line $Z_i$ has the power voltage $V_{DD}$ higher than the reference voltage $V_{ss}$. Therefore, forward bias voltages are applied to the organic EL elements $E_{i,1}$ to $E_{i,n}$ of the i-th row. Furthermore, since each transistor 21 of the i-th row has the off state, the driving current does not flow through the signal lines $Y_1$ to $Y_n$ via the transistors 21, and flows through the organic EL elements $E_{i,1}$ to $E_{i,n}$ of the i-th row by the function of the transistor 23, and the organic EL elements $E_{i,1}$ to $E_{i,n}$ emit the light.

That is, in the pixel circuits $D_{i,1}$ to $D_{i,n}$, the transistors 21 and 22 function to confine the electric charges of the capacitors 24 charged in accordance with the gradation designating current between the source and drain of each transistor 23 in the selection period $T_{SE}$ in the non-selection period $T_{SE}$. Each transistor 21 functions so as to electrically disconnect the signal line $Y_j$ from the transistor 23 so that the driving current flowing through each transistor 23 does not flow through the signal lines $Y_1$ to $Y_n$ in the non-selection period $T_{SE}$. Furthermore, each capacitor 24 functions so as to charge the electric charges for holding the gate/source voltage of each transistor 23 set to be stationary when the transistor 23 passes the gradation designating current. Each transistor 23 functions so as to pass the driving current having the current value equal to that of the gradation designating current through the organic EL elements $E_{i,1}$ to $E_{i,n}$ in accordance with the gate/source voltage held by each capacitor 24.

As described above, in the selection period $T_{SE}$ of the i-th row, the gradation designating current having the desired current value is forcibly passed through the transistors 23 of the pixel circuits $D_{i,1}$ to $D_{i,n}$ of the i-th row, therefore the current value of the driving current through the organic EL elements $E_{i,1}$ to $E_{i,n}$ is obtained as desired, and the organic EL elements $E_{i,1}$ to $E_{i,n}$ emit the light at a predetermined gradation luminance.

When the current designating system is applied to the active matrix driving display apparatus, the current value of the driving current flowing through each organic EL element per unit time can be reduced. For this, in the non-selection period, with the gradation designating current having the current value equal to that of the driving current, a capacity C of a current path to the signal line $Y_j$ from the source 23*s* of the third transistor 23 has to be quickly charged.

Here, in the pixel $P_{i,j}$, the current value of the gradation designating current, which is passed through the signal line $Y_j$ in order to emit the light from the organic EL element $E_{i,j}$ at a highest gradation luminance Lhsb in the non-selection period $T_{NSE}$ of the i-th row, is defined as Ihsb in the selection period $T_{SE}$ of the i-th row. Subsequently, in the pixel $P_{i+1,j}$, the current value of the gradation designating current, which is passed through the signal line $Y_j$ in order to emit the light from the organic EL element $E_{i+1,j}$ at a lowest gradation luminance Llsb (additionally, the micro current flows, and the organic EL element $E_{i+1,j}$ emits the light at a low luminance) in the non-selection period $T_{NSE}$ of the (i+1)st row, is defined as Ilsb in the selection period $T_{SE}$ of the (i+1)st row. Then, the following relation is obtained:

$$Ihsb>Ilsb \quad (5).$$

The voltage applied to one end of the signal line $Y_j$ on the side of the data driver 3 is defined as Vhsb so that the signal line $Y_j$ obtains the stationary state at the current value Ihsb. The voltage applied to one end of the signal line $Y_j$ on the side of the data driver 3 is defined as Vlsb so that the signal line $Y_j$ obtains the stationary state at the current value Ilsb. Then, the following relation is obtained:

$$V_{CH}>Vlsb>Vhsb \quad (6)$$

That is, when the potential difference between the drain 23*d* and source 23*s* of the transistor 23 is $V_{CH}$−Vlsb and low, the current value of the source/drain current flowing through the transistor 23 decreases to Ilsb. When the potential difference between the drain 23*d* and source 23*s* of the transistor 23 is $V_{CH}$−Vhsb and high, the current value of the source/drain current flowing through the transistor 23 increases to Ihsb.

A charge amount Q1 accumulated in the current path to the signal line $Y_j$ from the source electrode 23*s* of the transistor 23 in order to modulate the lowest gradation luminance Llsb to the highest gradation luminance Lhsb is as follows:

$$Q1=C(Vlsb-Vhsb) \quad (7),$$

the current value of the current flowing through the signal line $Y_j$ in order to accumulate the charge amount Q1 is Ihsb, and the charge amount Q1 can quickly be charged because of a relatively large current. C denotes the capacity of the current path.

On the other hand, a charge amount Q2 accumulated in order to modulate the highest gradation luminance Lhsb to the lowest gradation luminance Llsb is equation an absolute value of the charge amount Q1, but the current flowing through the signal line $Y_j$ at this time is Ilsb.

Here, in the constitution according to a comparative example in which the current/voltage switch portion 7 is removed from the display apparatus 1 of the present invention, the voltage Vhsb is applied in one end of the signal line $Y_j$ on the data driver 3 side in order to pass the gradation designating current having the current value Ihsb through the signal line $Y_j$ in the selection period $T_{SE}$ of the i-th row and to obtain the stationary current value Ihsb. Thereafter, the voltage Vlsb is applied in one end of the signal line $Y_j$ on the data driver 3 side in order to pass the gradation designating current having the current value Ilsb through the signal line $Y_j$ in the selection period $T_{SE}$ of the (i+1)st row and to obtain the stationary gradation designating current. In this case, since the current value Ilsb of the gradation designating current is remarkably small, as shown in FIG. 9A, much time is required for obtaining the voltage Vlsb of the stationary state and a high-rate response is impossible. Therefore, it is especially difficult to smoothly display an image whose image data easily changes like a dynamic image.

However, in the display apparatus 1 in which the current/voltage switch portion 7 is disposed as shown in FIG. 1, between the time $t_{iR}$ when the selection period $T_{SE}$ of the i-th row ends and the time $t_{i+1}$ when the selection period $T_{SE}$ of the (i+1)st row starts, that is, in the reset period $T_{RESET}$ of the (i+1)st row, the switch signal ϕ inputted into the switch signal input terminal 140 is of the high level, the fourth transistor 31 obtains the off state, and the fifth transistor 32 obtains the on state. Therefore, as shown in FIG. 9B, in the reset period $T_{RESET}$ of the (i+1)st row, the gradation designating current does not flow through any of the signal lines $Y_1$ to $Y_n$, but the reset voltage $V_R$ is forcibly applied to all the signal lines $Y_1$ to $Y_n$.

The reset voltage $V_R$ is set to at least a voltage higher than the highest gradation voltage Vhsb set to be stationary in accordance with the electric charges charged in the signal lines $Y_1$ to $Y_n$ by the gradation designating current having the current value equal to that of the maximum gradation driving current $I_{MAX}$ flowing through the organic EL elements $E_{1,1}$ to $E_{m,n}$, when the organic EL elements $E_{1,1}$ to $E_{m,n}$ emit the light at the brightest maximum gradation luminance $L_{MAX}$ in the selection period $T_{SE}$. The reset voltage $V_R$ is preferably set to be not less than the intermediate voltage which has the intermediate value between the lowest gradation voltage Vlsb set to be stationary in accordance with the electric charges charged in the signal lines $Y_1$ to $Y_n$ by the gradation designating current having the current value equal to that of the minimum gradation driving current $I_{MIN}$ flowing through the organic EL elements $E_{1,1}$ to $E_{m,n}$, when each of the organic EL elements $E_{1,1}$ to $E_{m,n}$ has the minimum gradation luminance $L_{MIN}$ (additionally, the current value exceeds 0 A), and the highest gradation voltage Vhsb, more preferably the value equal to or more than the lowest gradation voltage Vlsb, most preferably the voltage equal to the charge voltage $V_{CH}$.

In this manner, since the reset voltage $V_R$ is higher than at least the highest gradation voltage Vhsb, in the reset period, the potential difference between the source and drain of the transistor 23 can be set to be lower than $V_{CH}$−Vhsb. That is, the electric charges of the capacity C of the current path to the signal line $Y_j$ from the source electrode 23*s* of the third transistor 23 is charged so that the relatively low gradation driving current, that is, the relatively small gradation designating current can quickly be stationary, and the potential of the signal lines $Y_1$ to $Y_n$ is quickly stationary at the reset voltage $V_R$.

Moreover, when the selection period $T_{SE}$ of the (i+1)st row starts, in the same manner as in the i-th row, a selection scanning line $X_{i+1}$ and power scanning line $Z_{i+1}$ are selected by the selection scanning driver 5 and power scanning driver 6, and further the fourth transistor 31 obtains the on state. Accordingly, in each column, the gradation designating current flows through the power scanning line $Z_{i+1}$→the third transistor 23→the transistor 21→the signal line Y→the fourth transistor 31→the data driver 3. Thereafter, in the non-selection period $T_{NSE}$ of the (i+1)st row, in the same manner as in the i-th row, the organic EL elements $E_{i+1,1}$ to $E_{i+1,n}$ of the (i+1)st row emit the light at the luminance gradation in accordance with the current value of each driving current.

Here, the time dt required for bringing the voltage in the power scanning line $Z_{i+1}$, the transistor 23, the transistor 21, the transistor 31, and the data driver 3 into the stationary state by the gradation designating current in the selection period $T_{SE}$ of the (i+1)st row is represented by the above equations (2) to (4). If the current value of the gradation designating current flowing through the signal lines $Y_1$ to $Y_n$ in the selection period $T_{SE}$ of the i-th row is large, and the current value of the gradation designating current flowing through the signal lines $Y_1$ to $Y_n$ in the selection period $T_{SE}$ of the (i+1)st row is small like the current value Ilsb at a lowest gradation luminance Llsb time, the voltage for the signal lines $Y_1$ to $Y_n$ to obtain the gradation designating current of the (i+1)st row is set to be stationary. Then dt lengthens as represented by the above equations (2) to (4), and there is possibility that dt is longer than the selection period $T_{SE}$. Therefore, if the current value of the gradation designating current is small in the selection period $T_{SE}$ of the (i+1)st row as described above, for the display apparatus 1 in which the current/voltage switch portion 7 is not disposed, as shown in FIG. 9A, the selection period $T_{SE}$ of the (i+1)st row ends before the voltages applied to the capacitor 24 and third transistor 23 obtain the stationary state. There is possibility that the current value of the driving current of the organic EL elements $E_{i+1,1}$ to $E_{i+1,n}$ of the (i+1)st row is different from that of the gradation designating current.

However, since the current/voltage switch portion 7 is disposed in the display apparatus 1 of the present embodiment, the reset period $T_{RESET}$ is set immediately before the selection period $T_{SE}$ of the (i+1)st row. In order to set the signal lines $Y_1$ to $Y_n$ to be stationary at the current value of the gradation designating current when the organic EL elements $E_{i+1,1}$ to $E_{i+1,n}$ of the (i+1)st row emit the light at the low luminance, the reset voltage $V_R$ is applied so as to quickly charge the electric charges in the capacity C of the current path, and the potential of the signal lines $Y_1$ to $Y_n$ quickly rises. Especially, when the reset voltage $V_R$ is set to a value in the vicinity of the charge voltage $V_{CH}$ or the lowest gradation voltage Vlsb, and even when the current of the low luminance such as the lowest gradation current Ilsb for the lowest gradation luminance Llsb is passed through the signal lines $Y_1$ to $Y_n$ in the selection period $T_{SE}$ of the (i+1)st row, as represented by the above equations (2) to (4), the change amounts of the electric charges of the signal lines $Y_1$ to $Y_n$ in the reset period $T_{RESET}$ and in the selection period $T_{SE}$ of the (i+1)st row can be minimized.

Therefore, even when the gradation designating current of the (i+1)st row is the lowest gradation current Ilsb for the lowest gradation luminance Llsb, the signal lines $Y_1$ to $Y_n$ obtain the stationary state at the lowest gradation voltage Vlsb in the selection period $T_{SE}$ of the (i+1)st row. The electric charges can be charged in the capacitor 24 in accordance with the current value of the gradation designating current in the selection period $T_{SE}$, and the luminance gradation of the pixel can quickly be updated.

Moreover, in the same pixel $P_{i,j}$, the capacitor 24 is charged with a large charge amount to obtain the high gradation luminance in the previous scanning period $T_{SC}$ (or the previous emission period $T_{EM}$). In the state, when the charge amount of the capacitor 24 is reduced to update the luminance to the low gradation luminance in the next scanning period $T_{SC}$, that is, when the current path varies to the low gradation high voltage controlled by the micro gradation designating current from the high gradation low voltage controlled by the large gradation designating current, the current by the reset voltage $V_R$ is passed through the signal lines $Y_1$ to $Y_n$ immediately before. Accordingly, the electric charges of the current path are shifted on the low gradation high voltage side. Therefore, when the signal lines $Y_1$ to $Y_n$ and the capacitor 24 are regarded as one capacitor, the charge amount of the capacitor can be brought close to a low gradation side before the selection period $T_{SE}$. That is, the potential of the capacitor 24 and signal lines $Y_1$ to $Y_n$ can quickly be stationary so as to quickly charge the electric charges in each capacitor 24 in accordance with the low gradation designating current, even when the current value of the desired low gradation designating current is small.

Therefore, the voltage of one pole of each capacitor 24 of the pixels $P_{+1,1}$ to $P_{i+1,n}$ in the selection period $T_{SE}$ of the (i+1)st row and the potential of the signal lines $Y_1$ to $Y_n$ quickly obtain the stationary state without depending on the current value of the gradation designating current. Therefore, with any gradation, the current value of the driving current in the emission period $T_{EM}$ (non-selection period $T_{NSE}$) is the same as that of the designated current of the previous selection period $T_{SE}$, and the organic EL elements $E_{i+1,1}$ to $E_{i+1,n}$ emit the light at the desired emission luminance. In other words, without lengthening the selection period $T_{SE}$ of each row, the organic EL element $E_{i,j}$ emits the light at the desired luminance. Therefore, the display screen does not blink, and the display quality of the display apparatus 1 can be raised.

Second Embodiment

Figure 10:
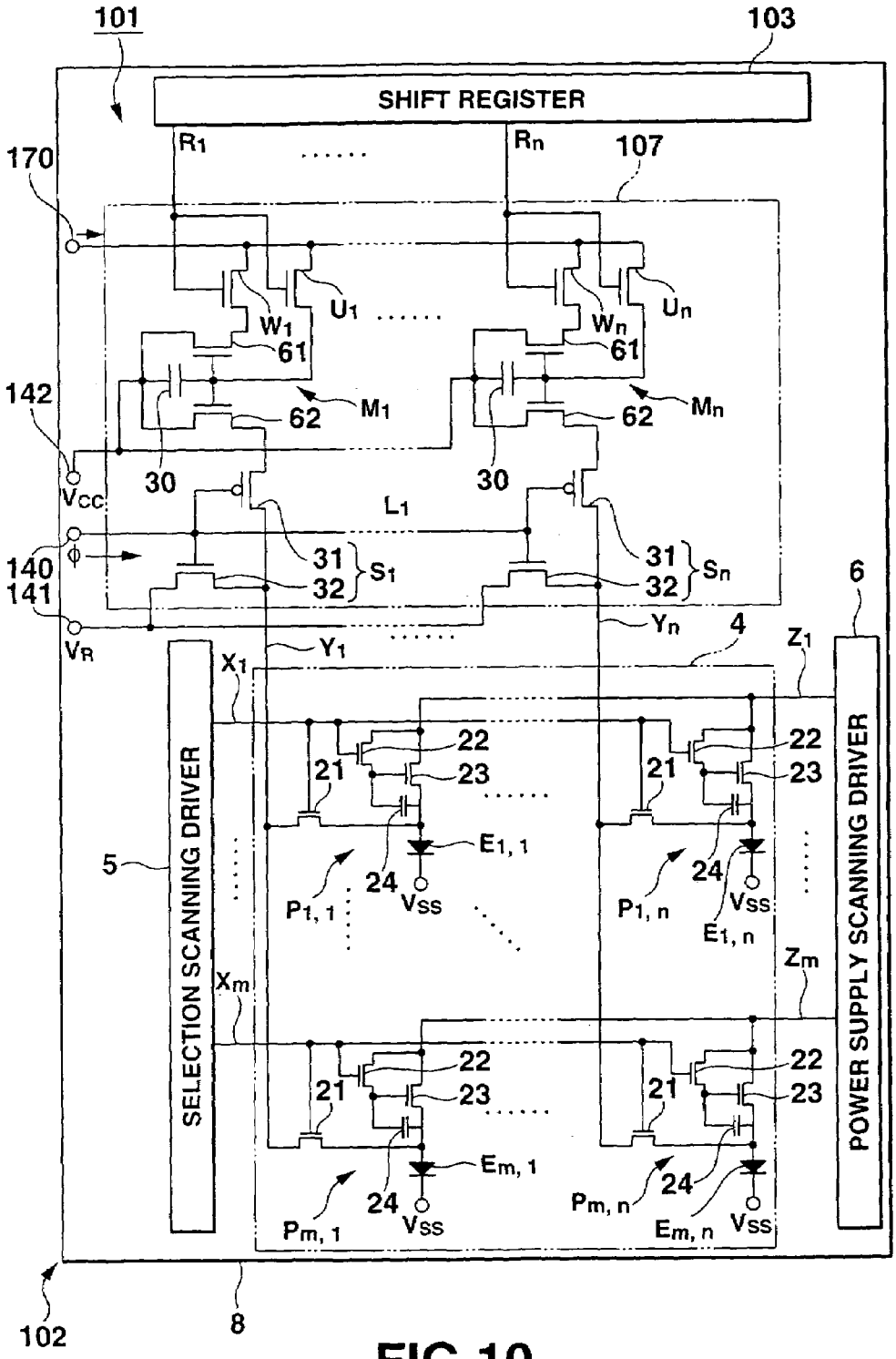
FIG. 10 is a circuit diagram showing a concrete mode of another display apparatus to which the present invention is applied.

FIG. 10 is a diagram showing a display apparatus 101 of a mode separate from that of the display apparatus 1 of the first embodiment. As shown in FIG. 10, the display apparatus 101 includes the basic constitution including an organic EL display panel 102 which performs the color display by the active matrix driving system, and a shift register 103.

The organic EL display panel 102 includes: the transparent substrate 8; the display portion 4 in which the image is substantially displayed; the selection scanning driver 5 disposed around the display portion 4; the power scanning driver 6; and a current/voltage conversion portion 107, to form the basic constitution. These circuits 4 to 6, 107 are formed on the transparent substrate 8. The display portion 4, selection scanning driver 5, power scanning driver 6, and transparent substrate 8 are the same as in the display apparatus 1 of the first embodiment. Therefore, even with the organic EL display 101 of the second embodiment, the voltage application timing by the selection scanning driver 5, the voltage application timing by the power scanning driver 6, the update of the pixels $P_{1,1}$ to $P_{m,n}$, and the gradation representation of the pixels $P_{1,1}$ to $P_{m,n}$ are the same as in the display apparatus 1 of the first embodiment.

In the current/voltage conversion portion 107, the switch circuits $S_j$ to $S_n$ constituted of the fourth transistor 31 and fifth transistor 32 are disposed for each column. Additionally, current mirror circuits $M_1$ to $M_n$ and transistors $U_1$ to $U_n$ and transistors $W_1$ to $W_n$ control the current mirror circuits $M_1$ to $M_n$ are disposed. One end of the current/voltage conversion portion 107 is connected to the signal lines $Y_1$ to $Y_n$, and the other end is connected to the shift register 103.

The current mirror circuit $M_j$ is constituted of a capacitor 30 and two MOS type transistors 61, 62. The transistors 61, 62, 31, 32, $U_1$ to $U_n$, and $W_1$ to $W_n$ are field-effect thin film transistors of the MOS type, especially a-Si transistors in which amorphous silicon is used as a semiconductor layer, but may also be a p-Si transistor in which polysilicon or monocrystalline silicon is used in the semiconductor layer.

The structures of the transistors 31, 32, $U_1$ to $U_n$, and $W_1$ to $W_n$ may also be of an inverse stagger type or coplanar type. In the following, the transistors 61, 62, 32, $U_1$ to $U_n$, and $W_1$ to $W_n$ will be described as the field-effect transistors of the N channel type, and the transistor 31 will be described as the field-effect transistor of the P channel type.

A channel length of the transistor 61 is the same as that of the transistor 62, and a channel width of the transistor 61 is longer than that of the transistor 62. That is, a channel resistance of the transistor 62 is higher than that of the transistor 61. For example, the channel resistance of the transistor 62 is ten times that of the transistor 61. In this manner, when the channel resistance of the transistor 62 is higher than that of the transistor 61, the channel lengths of the transistors 61 and 62 may not be the same.

Each column will be described. For the current mirror circuit $M_j$, the drain electrode of the transistor 61 is connected to the source electrode of the transistor $W_j$, and the gate electrodes of the transistors 61 and 62 are connected to the source electrode of the transistor $U_j$, and also to one pole of the capacitor 30. The drain electrode of the transistor 62 is connected to the source electrode of the transistor 31. The source electrodes of the transistors 61 and 62 are connected to each other, also to the other pole of the capacitor 30, and further to a low voltage input terminal 142 of a low current/voltage switch portion $V_{CC}$ at a constant level. The low current/voltage switch portion $V_{CC}$ of the low voltage input terminal 142 is lower than the reference voltage $V_{ss}$, further lower than the charge voltage $V_{CH}$, and for example, −20 [V].

In the j-th column, the drain electrodes of the transistors 31, 32 are both connected to the signal line $Y_j$, and the gate electrodes of the transistors 31, 32 are both connected to the switch signal input terminal 140. The source electrode of the transistor 32 of each column is connected to the reset voltage input terminal 141.

The gate electrodes of the transistors $U_j$ and $W_j$ are connected to each other, and connected to an output terminal $R_j$ of the shift register 103. The drain electrodes of the transistors $U_j$ and $W_j$ are connected to each other, and connected to a common gradation signal input terminal 170.

The shift register 103 shifts the pulse signal based on the clock signal from the outside, successively outputs the pulse signal of an on level to an output terminal $R_n$ from output terminal $R_1$ in order (the output terminal $R_1$ is next to the output terminal $R_n$), and accordingly successively selects the current mirror circuits $M_1$ to $M_n$. One shift period of the shift register 103 is shorter than that of the selection scanning driver 5 or the power scanning driver 6. While the selection scanning driver 5 or power scanning driver 6 shifts the pulse signal to the (i+1)st row from the i-th row, the shift register 103 shifts the pulse signal for one row to the output terminal $R_n$ from output terminal $R_1$ in order, and outputs n pulse signals of the on level.

The gradation signal input terminal 170 outputs of the gradation signal of an external data driver, and this gradation signal is set such that the current mirror circuits $M_1$ to $M_n$ successively selected by the pulse signal of the shift register 103 pass the gradation designating current having the current value in accordance with the gradation. By the gradation designating current, in the selection period $T_{SE}$, the current in accordance with the luminance gradation of the organic EL elements $E_{1,1}$ to $E_{m,n}$ is passed between the source and drain of the transistor 23 and through the signal lines $Y_1$ to $Y_n$. Accordingly, in the non-selection period $T_{NSE}$ (emission period $T_{EM}$) the current flows between the source and drain of the transistor 23 and through the organic EL elements $E_{1,1}$ to $E_{m,n}$ in accordance with the luminance gradation. The gradation designating current may also be an analog or digital signal, and is inputted into the drain electrodes of the transistors $U_1$ to $U_n$ and $W_1$ to $W_n$ at a timing at which the pulse signal of the on level is inputted from the output terminals $R_1$ to $R_n$ of the shift register 103. The period of the gradation designating current for one row is shorter than one shift period of the selection scanning driver 5 or power scanning driver 6. While the selection scanning driver 5 or power scanning driver 6 shifts the pulse signal to the (i+1)st row from the i-th row, n gradation designating currents are inputted.

The switch signal ϕ is inputted into the switch signal input terminal 140 from the outside. The period of the switch signal ϕ is the same as one shift period of the selection scanning driver 5 or power scanning driver 6. A timing when the switch signal ϕ of the on level of the transistor 31 is inputted is a time at which the selection scanning driver 5 or power scanning driver 6 outputs the on-level pulse signals of the transistors 21, 22. Therefore, while the selection scanning driver 5 or power scanning driver 6 shifts to the m-th row from the first row, m on-level voltages of the switch signal ϕ are inputted.

When the gradation signal is outputted from the gradation signal input terminal 170, the voltages are applied to the drain electrode and gate electrode of the transistor 61, and the current flows between the drain and source of the transistor 61. At this time, the current also flows between the drain and source of the transistor 62. Here, the channel resistance of the transistor 62 is higher than that of the transistor 61, and the gate electrode of the transistor 62 has the same voltage level as that of the gate electrode of the transistor 61. Therefore, the current value of the current between the drain and source of the transistor 62 is smaller than that of the current between the drain and source of the transistor 61. Concretely, the current value of the current between the drain and source of the transistor 62 is substantially a value (product) obtained by multiplying a ratio of the channel resistance of the transistor 62 to that of the transistor 61 by the current value of the current between the drain and source of the transistor 61. The current value of the current between the drain and source of the transistor 62 is lower than that of the current between the drain and source of the transistor 61. Therefore, the micro gradation designating current flowing through the transistor 62 can easily be gradated/controlled. The ratio of the channel resistance of the transistor 62 to that of the transistor 61 will hereinafter be referred to as a current decrease ratio.

Next, the operation of the display apparatus 101 constituted as described above will be described. In the same manner as in the first embodiment, as shown in FIG. 8, the selection scanning driver 5 and power scanning driver 6 linearly successively shift the pulse signal to the m-th row from the first row.

Figure 11:
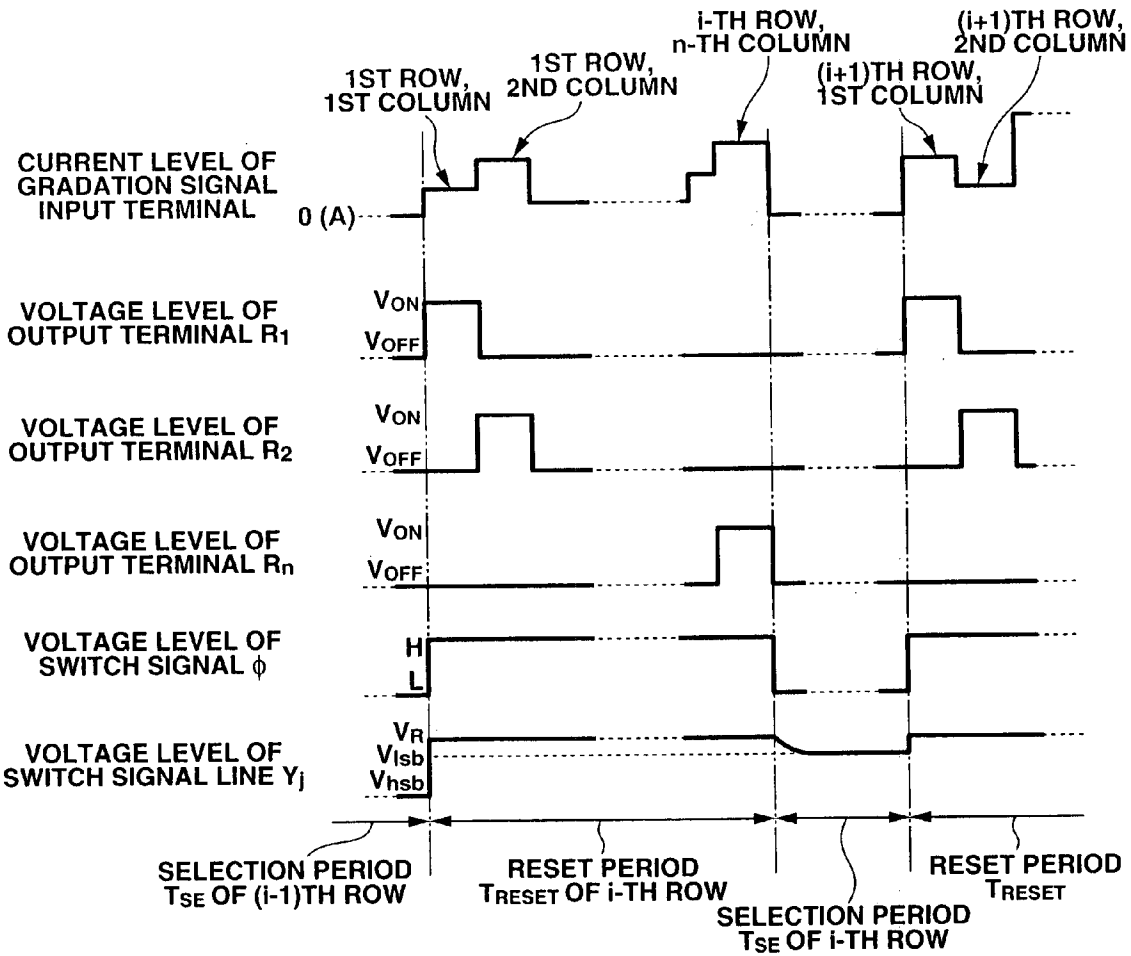
FIG. 11 is a timing chart showing a level of a signal in the display apparatus of FIG. 10.

On the other hand, as shown in FIG. 11, from the end of the selection period $T_{SE}$ of the (i−1)st row till the beginning of the selection period $T_{SE}$ of the i-th row, that is, in the reset period $T_{RESET}$, the shift register 103 shifts the pulse signals of the on-levels of the transistors $U_1$ to $U_n$, and $W_1$ to $W_n$ to the output terminal $R_n$ from the output terminal $R_1$. While the shift register 103 shifts the pulse signal, the voltage level of the switch signal ϕ of the switch signal input terminal 140 corresponds to the off level of the transistor 31, and is maintained at high level H of the on level of the transistor 32. Therefore, in the reset period $T_{RESET}$, in the signal lines $Y_1$ to $Y_n$, the voltage is quickly displaced to the reset voltage $V_R$ from the reset voltage input terminal 141.

Here, when the shift register 103 outputs the pulse signal of the on level to the output terminal $R_j$, the gradation signal input terminal 170 inputs the gradation signal of the level indicating the gradation luminance of the i-th row and j-th column. At this time, since the transistors $U_j$ and $W_j$ of the j-th column have the on state, the gradation signal of the current value indicating the value for the gradation luminance of the i-th row and j-th column is inputted into the current mirror circuit $M_j$, the transistors 61 and 62 obtain the on state, and the electric charges having the size in accordance with the current value of the gradation signal is charged in the capacitor 30. That is, the transistors $U_j$ and $W_j$ function so as to take the gradation signal into the current mirror circuit $M_j$ at a selection time of the j-th column.

When the transistor 61 obtains the on state, in the current mirror circuit $M_j$, the current flows through the gradation signal input terminal 170→the transistor 61→the low voltage input terminal 142. The current value of the current flowing through the gradation signal input terminal 170→the transistor 61→the low voltage input terminal 142 follows that of the gradation signal.

At this time, since the level of the switch signal input terminal 140 corresponds to the off level of the transistor 31, the transistor 31 of the j-th column has the off state, and the gradation designating current flowing through the current mirror circuit $M_j$ and signal line $Y_j$ does not flow.

Subsequently, when the shift register 103 outputs the pulse signal to the output terminal $R_{j+1}$, the gradation signal of the current value indicating the value for the gradation luminance of the i-th row and (j+1)st column is inputted. In the same manner as in the j-th column, the electric charges having the size in accordance with the current value of gradation signal is charge in the capacitor 30 of the (j+1)st column. At this time, even when the transistors $U_j$, $W_j$ of the j-th column obtain the off state, the electric charges charged in the capacitor 30 of the j-th column is confined by the transistor $U_j$, and therefore the transistors 61 and 62 of the j-th column maintain the on state. That is, the transistor $U_j$ functions so as to hold the gate voltage level in accordance with the current value of the current of the gradation signal at the selection time of the j-th column even at the non-selection time of the j-th column.

As described above, when the shift register 103 shifts the pulse signal, the electric charges having size in accordance with the current value of the gradation signal is successively charged into the capacitor 30 of the n-th column from the capacitor 30 of the first column. When the charging into the capacitor 30 of the n-th column ends, the shift of the shift register 103 once ends, the switch signal ϕ of the switch signal input terminal 140 switches to the off level from the high level. All the transistors 31 simultaneously obtain the on state, and all the transistors 32 obtain the off state. At this time, since the charges are charged in the capacitors 30 of all the columns, the transistors 61, 62 have the on state. Moreover, since this time is the selection period of the i-th row, the gradation designating current flows through the power scanning line $Z_i$→the transistor 23→the transistor 21→the signal lines $Y_1$ to $Y_n$→the transistor 62→the low voltage input terminal 142 in all the pixel circuits $D_i$, to $D_{i,n}$ of the i-th row. At this time, in any column of the first to n-th column, by the function of the current mirror circuit $M_j$, the current value of the gradation designating current flowing in the direction of the power scanning line $Z_i$→the transistor 23→the transistor 21→the signal lines $Y_1$ to $Y_n$→the transistor 62→the low voltage input terminal 142 is a value obtained by multiplying the current value of the current flowing in the direction of the gradation signal input terminal 170→the transistor 61→the low voltage input terminal 142 by the current decrease ratio of the current mirror circuit $M_j$.

In any of the signal lines $Y_1$ to $Y_n$, the relatively large gradation designating current having the high luminance is passed in the selection period $T_{SE}$ of the previous row, the electric charges are accumulated in the capacity of the current path to the signal line $Y_j$ from the source 23 of the transistor 23, and the potential lowers. In this case, even when the current value of the gradation designating current flowing in the next selection period $T_{SE}$ is small, the potential of the current path is high by the reset voltage $V_R$ applied in the previous reset period $T_{RESET}$. Therefore, it is possible to quickly set the potential of the signal lines $Y_1$ to $Y_n$ to be stationary at the potential in accordance with the gradation sink current.

Subsequently, the pulse signals of the selection scanning driver 5 and power scanning driver 6 shift to the (i+1)st row, and the non-selection period $T_{SE}$ of the i-th row is obtained. In the same manner as in the first embodiment, the gradation luminance of the organic EL elements $E_{i,1}$ to $E_{i,n}$ of the i-th row is updated.

Subsequently, the switch signal input terminal 140 reaches the high level, and the shift register 103 similarly repeats the shift of the pulse signal to the n-th column from the first column. Accordingly, to update the gradation luminance of the organic EL elements $E_{i+1,1}$ to $E_{i+1,n}$ of the (i+1)st row, the electric charges are successively charged in the capacitors 30 of the n-th column from the first column.

In the second embodiment, since the current mirror circuit $M_j$ is disposed outside the display portion 4, the number of transistors disposed for each pixel can be minimized, and the drop of numerical aperture of the pixel can be inhibited. Since the current mirror circuit $M_j$ is disposed, and even when the gradation signal slightly deviates from the current value to be originally outputted because of ambient noises or parasitic capacities in the gradation signal input terminal 170, the deviation of the gradation designating current value of the signal line $Y_j$ is minimized according to the current decrease ratio, and further the deviation of the luminance gradation of the organic EL element E can be suppressed.

Figure 12:
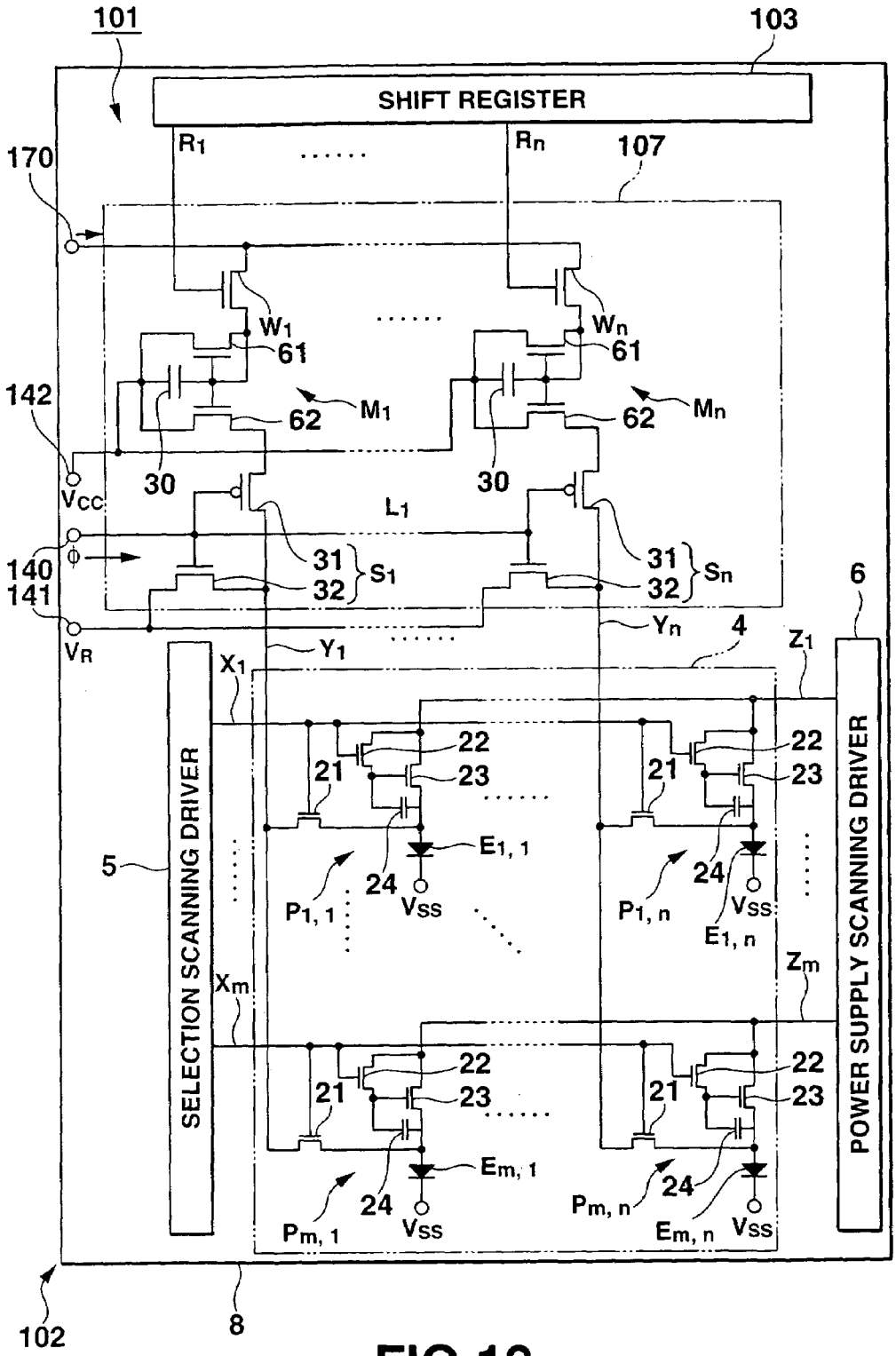
FIG. 12 is a circuit diagram showing the concrete mode of another display apparatus to which the present invention is applied.

In the embodiment shown in FIG. 10, the transistors $U_1$ to $U_n$ which control the current mirror circuits $M_1$ to $M_n$ are disposed. However, as shown in FIG. 12, the source electrodes of the transistors $W_1$ to $W_n$ are connected to the drain electrode of the transistor 61, the gate electrode of the transistor 61, and the gate electrode of the transistor 62, the transistors $U_1$ to $U_n$ can be omitted.

Figure 13:
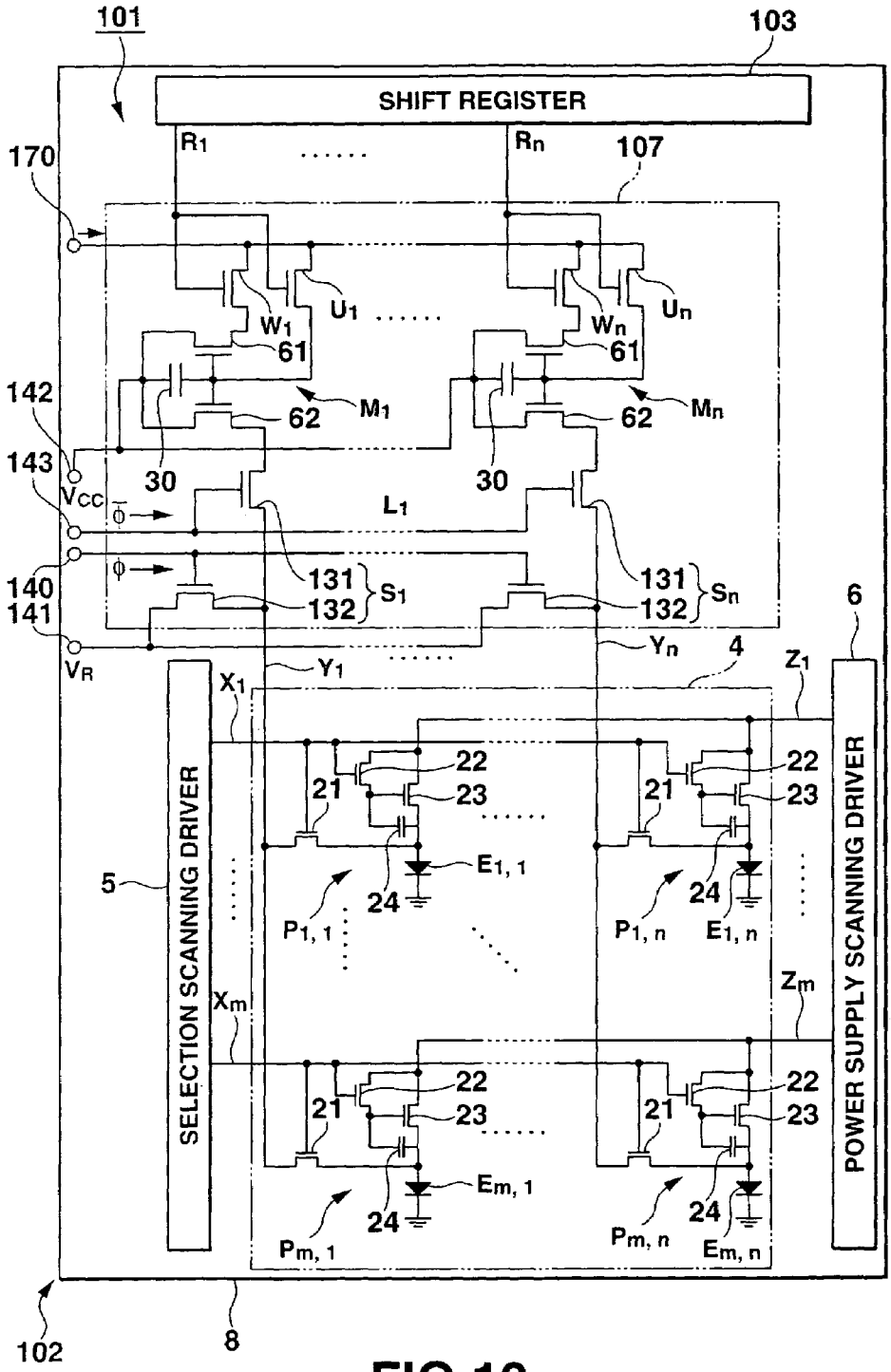
FIG. 13 is a circuit diagram showing the concrete mode of another display apparatus to which the present invention is applied.

In the above embodiment, the switch circuits $S_1$ to $S_n$ include CMOS structures of N channel and P channel transistors, but as shown in FIG. 13, the same channel type transistors as those of the current mirror circuits $M_1$ to $M_n$ are disposed. The transistor of the current/voltage conversion portion 107 may include only a single-channel type transistor. In this manner, it is possible to simplify the manufacturing process of the current/voltage conversion portion 107.

Furthermore, the channel type of the transistor of the current/voltage conversion portion 107 is the same as that of the transistors 21 to 23 in the display portion 4. Then, the transistor in the current/voltage conversion portion 107 can collectively be formed with the transistors 21 to 23 in the display portion 4. If the transistor of the same channel type as that of the transistors 21 to 23 of the display portion 4 is partially disposed in the current/voltage conversion portion 107, needles to say, the transistors can simultaneously be formed.

In a display apparatus 201 shown in FIG. 13, each of the switch circuits $S_1$ to $S_n$ is constituted of: a N channel type transistor 132 connected to the switch signal input terminal 140 into which the switch signal ϕ is inputted; and an N channel type transistor 131 connected to a switch signal input terminal 143 to which a switch signal ¬ϕ (¬ is logic negation) as a reverse signal of the switch signal ϕ is inputted.

Figure 14:
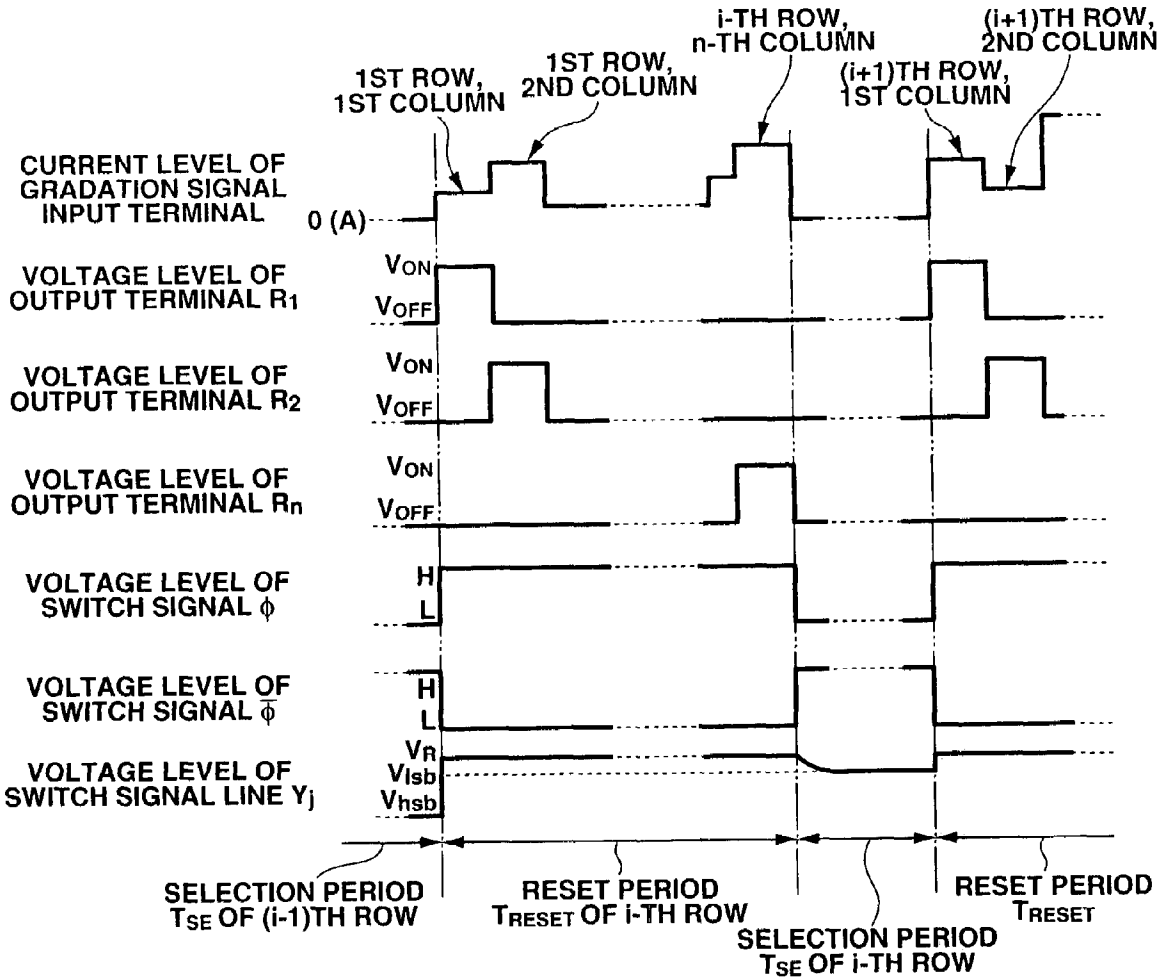
FIG. 14 is a timing chart showing the level of the signal in the display apparatus of FIG. 13.

As shown in FIG. 14, the transistor 131 obtains the on state in the selection period $T_{SE}$ by the switch signal ¬ϕ, functions as a switch for passing a micro gradation designating current to the power scanning lines $Z_1$ to $Z_m$, transistor 23, transistor 21, signal lines $Y_1$ to $Y_n$, transistor 62, and low voltage input terminal 142, and obtains the off state in the reset period $T_{RESET}$. The transistor 132 obtains the off state in the selection period $T_{SE}$ by the switch signal ϕ, obtains the on state in the reset period $T_{RESET}$, and functions as the switch for applying the reset voltage $V_R$ to the signal lines $Y_1$ to $Y_n$. Also in the switch circuits $S_1$ to $S_n$ shown in FIG. 1, the transistors 131, 132 of the same channel type may be used. Each transistor 131 may be connected to the switch signal input terminal 143, and the switch signal input terminal 140 may be connected to each transistor 132. Even in this case, the similar effect can be obtained.

Figure 15:
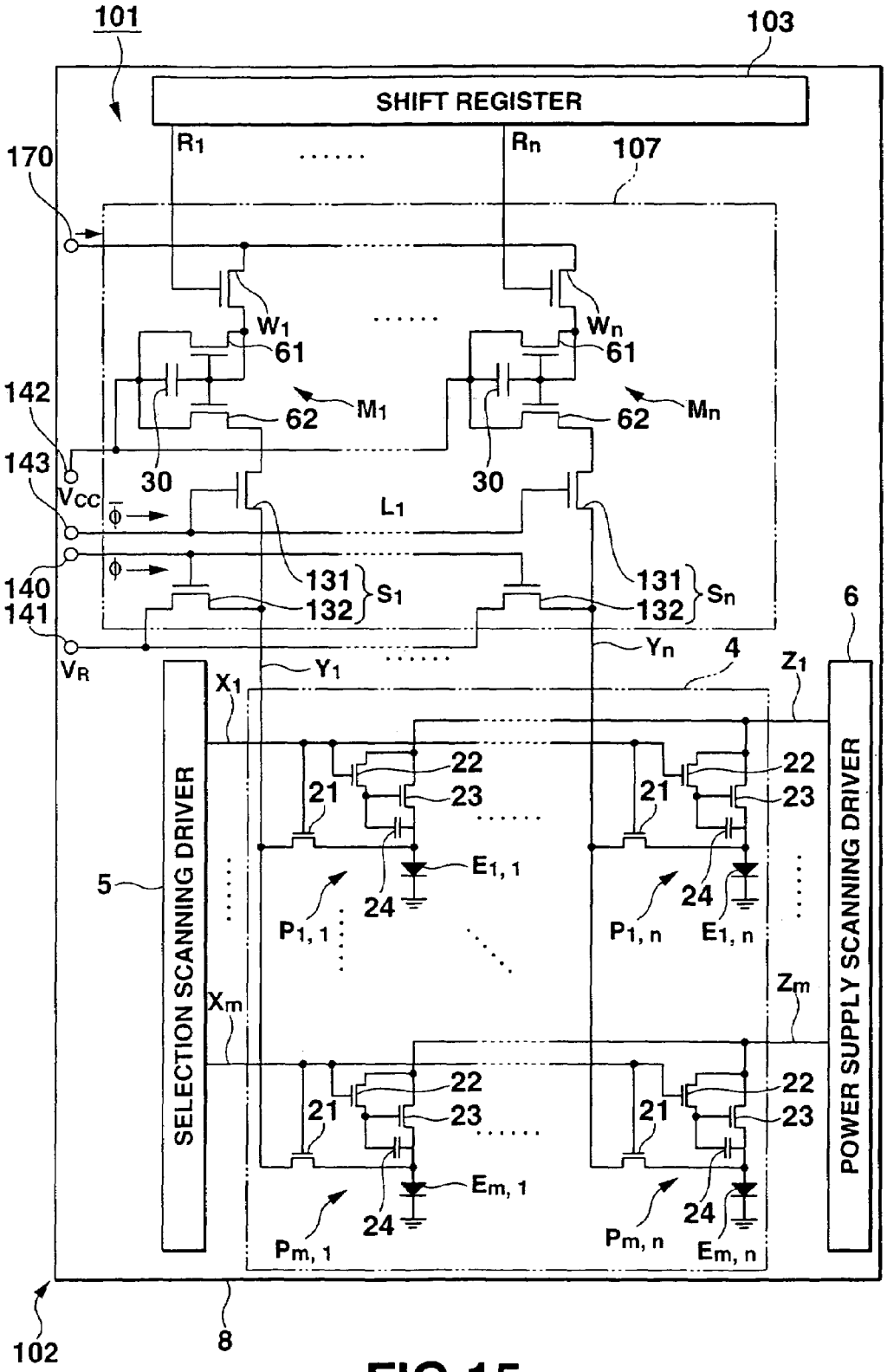
FIG. 15 is a circuit diagram showing the concrete mode of another display apparatus to which the present invention is applied.
Figure 16:
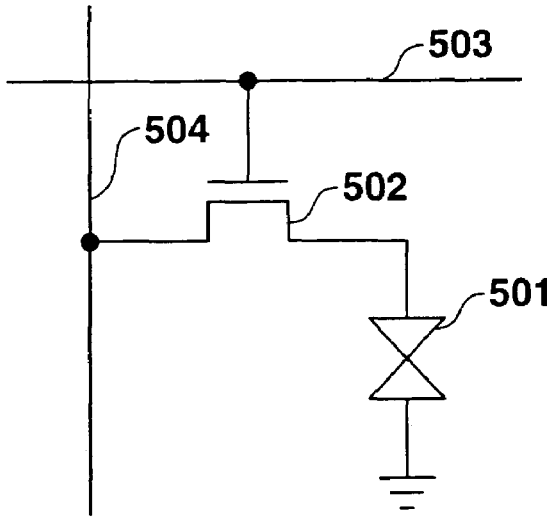
FIG.16 (RELATED ART)
FIG. 16 is a diagram showing an equivalent circuit of a pixel of a liquid crystal display.
Figure 17:
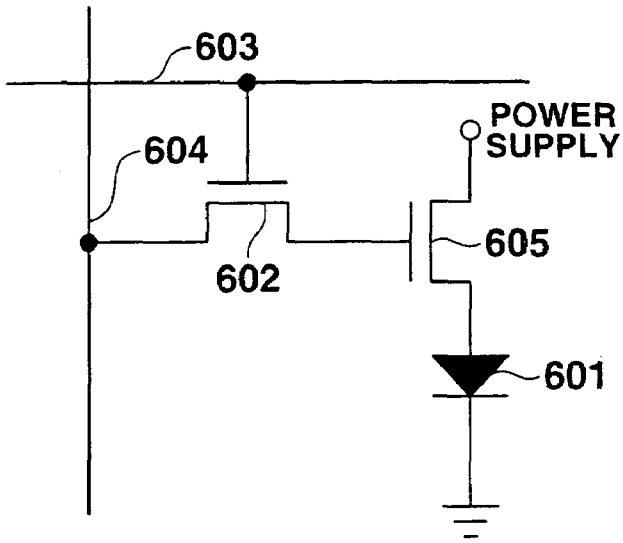
FIG.17 (RELATED ART)
FIG. 17 is a diagram showing the equivalent circuit of the pixel of a display apparatus of a voltage designating type.

In the embodiment shown in FIG. 13, the transistors $U_1$ to $U_n$ for controlling the current mirror circuits $M_1$ to $M_n$ are disposed. However, as shown in FIG. 15, when the source electrodes of the transistors $W_1$ to $W_n$ are connected to the drain electrode of the transistor 61, the gate electrode of the transistor 61, and the gate electrode of the 62, the transistors $U_1$ to $U_n$ can be omitted.

The present invention is not limited to the above-described embodiments, and may variously be modified and changed in design without departing from the scope of the present invention.

For example, in the display apparatus 1, the gradation luminance is designated in the pixel $P_{i,j}$ by the current value of the sink current extracted from the pixel $P_{i,j}$. However, conversely, the current may be passed through the pixel $P_{i,j}$ from the signal line $Y_j$, and the pixel $P_{i,j}$ may emit the light at the gradation luminance in accordance with the current value of the current. This display apparatus of the active matrix driving system may also be used.

Even in this case, the switch circuit passes the designated current of the data driver through the signal line in the selection period of each row, and the constant voltage of the constant level is applied to the signal line in the reset period between the selection periods. However, when the luminance gradation is higher, the signal line voltage is high and the signal line current is large. When the luminance gradation is low, the signal line voltage is low and the signal line current is small. Therefore, a potential relation is obtained such that the voltages $V_R$, Vlsb, Vhsb are vertically revered in FIG. 9B. The reset voltage $V_R$ is preferably set to a voltage lower than at least the highest gradation voltage Vhsb set to be stationary in accordance with the electric charges charged in the signal lines $Y_1$ to $Y_n$ by the gradation designating current having the current value equal to the maximum gradation driving current $I_{MAX}$ flowing through the organic EL elements $E_{1,1}$ to $E_{m,n}$, when the organic EL elements $E_{1,1}$ to $E_{m,n}$ emit the light at the brightest maximum gradation luminance $L_{MAX}$ in the selection period $T_{SE}$. The reset voltage is preferably set to be equal to or less than the intermediate voltage which has the intermediate value between the lowest gradation voltage Vlsb set to be stationary in accordance with the electric charges charged in the signal lines $Y_1$ to $Y_n$ by the gradation designating current having the current value equal to that of the minimum gradation driving current $I_{MIN}$ flowing through the organic EL elements $E_{1,1}$ to $E_{m,n}$, when each of the organic EL elements $E_{1,1}$ to $E_{m,n}$ has a darkest minimum gradation luminance $L_{MIN}$ (additionally, the current value exceeds 0 A), and the highest gradation voltage Vhsb, and more preferably a value equal to or less than the lowest gradation voltage Vlsb.

Further in this case, the circuit of the pixel $P_{i,j}$ may appropriately be changed. When the scanning line is selected, the designated current flowing through the signal line is passed through the pixel circuit to convert the current value of the designated current to the voltage level. When the scanning line is not selected, the designated current flowing through the scanning line is cut. The voltage level converted when the scanning line is not selected is held. Moreover, the pixel circuit for passing the driving current having the level in accordance with the held voltage level through the organic EL element is preferably disposed around each organic EL element.

In the embodiment, the organic EL element is used as the light emitting element. However, for example, there may be used a light emitting element in which the current does not flow when the reverse bias voltage is applied while it flows when the forward bias voltage is applied, and which may emit the light at the luminance in accordance with the size of the current flowing therein. Examples of the light emitting elements may include a light emitting diode (LED) element other than the organic EL element.

According to the present invention, when the pixel of the predetermined row is selected, the gradation current flows through each signal line. Even when a difference between the voltage set to be stationary by the gradation current flowing through the signal line for the pixel of the previous row and the voltage to be set to be stationary by the gradation current passed through the signal line for the pixel of the next row is large, and the current value of the gradation current for the next pixel is small, the reset voltage is applied to the signal line before the next row, thereby the signal line can quickly be set to be stationary at the voltage in accordance with the gradation current for the next row.

Therefore, after the next scanning line is selected, the current value of the driving current flowing through the light emitting element is the same as that of the designated current, and the light emitting element emits the light at the desired luminance. That is, without lengthening the period in which each scanning line is selected, the light emitting element emits the light at the desired luminance. Therefore, the display screen does not blink, and the display quality of the display apparatus is high.

The invention claimed is:

1. A display apparatus comprising:

a plurality of scanning lines arranged in a plurality of rows;

a plurality of signal lines arranged in a plurality of columns;

a plurality of pixels, each of which is arranged at an intersection of one of the scanning lines with one of the signal lines, and each of which comprises an optical element which is operated by a driving current, and a pixel circuit which supplies the driving current to the optical element;

a power supply driver connected to the plurality of pixels; and a data driver which is connected to the signal lines and which makes gradation currents flow from the power supply driver to each of the signal lines in a selection period;

wherein the pixel circuit of a given pixel in a given row is connected to one of the scanning lines and one of the signal lines and comprises:

charge hold means for holding electric charges in accordance with the gradation current which flows through the signal line in the selection period of the given row;

driving current switch means for passing the driving current, which has a current value that is substantially equal to a current value of the gradation current in accordance with the electric charges held by the charge hold means, through the optical element of the pixel after the selection period of the given row; and gradation current control switch means for controlling a flow of the gradation current, which flows via the driving current switch means through the signal line;

wherein the driving current switch means comprises a driving transistor;

wherein the gradation current control switch means comprises: (i) a current path control transistor having a source connected to the signal line, and a drain connected to a source of the driving transistor, and (ii) a data write control transistor having a source connected to a gate of the driving transistor, and a drain connected to a drain of the driving transistor;

wherein the power supply driver outputs, to the drain of the driving transistor, a charge voltage for the gradation current and a power voltage for the driving current; and wherein the display apparatus further comprises reset means for supplying a reset voltage to the signal line to which a potential in accordance with electric charges charged in the signal line by the gradation current is applied, the reset voltage being higher than a highest gradation voltage in the signal line, which is a voltage in the signal line when a gradation current equal to a highest gradation driving current flowing through the optical element is stationary in the signal line.

2. The display apparatus according to claim 1, wherein the reset means comprises:

means for passing the gradation current through the signal line connected to the pixel circuit during the selection period of the given row; and means for setting the potential of the signal line connected to the pixel circuit to the reset voltage after the selection period of the given row and before a selection period of a next row.

3. The display apparatus according to claim 1, wherein the reset means comprises:

a transistor for the gradation current, which passes the gradation current through the signal line; and a transistor for the reset voltage, which sets the potential of the signal line to the reset voltage.

4. The display apparatus according to claim 1, wherein the reset means comprises a current mirror circuit which generates the gradation current, which flows through the signal line, in accordance with a gradation signal.

5. The display apparatus according to claim 4, further comprising:

a shift register, wherein the reset means comprises one said current mirror circuit for each of the columns, and the reset means comprises gradation signal switch means for selectively supplying a gradation signal to each of the current mirror circuits in accordance with a signal from the shift register.

6. The display apparatus according to claim 1, wherein the reset voltage is a voltage between the highest gradation voltage in the signal line and a lowest gradation voltage in the signal line, and wherein the lowest gradation voltage is a voltage in the signal line when a gradation current equal to a lowest gradation driving current flowing through the optical element is stationary in the signal line.

7. The display apparatus according to claim 1, wherein the reset voltage is equal to a lowest gradation voltage in the signal line, which is a voltage in the signal line when a gradation current equal to a lowest gradation driving current flowing through the optical element is stationary in the signal line.

8. The display apparatus according to claim 1, wherein the gradation current control switch means passes the gradation current flowing through the signal line via the driving current switch means in the selection period of the given row to hold the electric charges in the charge hold means, and prevents the driving current from flowing through the signal line in an emission period of the given row.

9. The display apparatus according to claim 1, wherein the highest gradation voltage in the signal line is a voltage in the signal line when the gradation current equal to the highest gradation driving current flowing through the optical element is stationary in the signal line and the source of the driving transistor.

10. The display apparatus according to claim 1, wherein the reset voltage is a voltage between the highest gradation voltage in the signal line and a lowest gradation voltage in the signal line, and wherein the highest gradation voltage is a voltage in the signal line when a gradation current equal to the highest gradation driving current flowing through the optical element is stationary in the signal line and the source of the driving transistor, and the lowest gradation voltage is a voltage in the signal line when a gradation current equal to a lowest gradation driving current flowing through the optical element is stationary in the signal line and the source of the driving transistor.

11. The display apparatus according to claim 1, wherein the reset voltage is equal to a lowest gradation voltage in the signal line, which is a voltage in the signal line when a gradation current equal to a lowest gradation driving current flowing through the optical element is stationary in the signal line and the source of the driving transistor.

12. The display apparatus according to claim 1, wherein the reset voltage is equal to a voltage applied to the drain of the driving transistor, when the optical element performs an optical operation.

13. The display apparatus according to claim 1, wherein the optical element comprises an organic EL element.

14. The display apparatus according to claim 1, wherein the optical element comprises a light emitting diode.

15. A display apparatus comprising:

a plurality of signal lines to which gradation currents are supplied so as to obtain arbitrary current values;

a plurality of optical elements, each of which is coupled to one of the signal lines, and each of which performs an optical operation in accordance with the current value of the gradation current flowing via the signal line;

a plurality of driving circuits connected to the optical elements, respectively, each driving circuit coupling one of the optical elements to one of the signal lines, and each driving circuit controlling a driving current passing therethrough to the optical element connected thereto to have the arbitrary current value;

a power supply driver connected to the driving circuits;

a data driver which is connected to the signal lines and which makes the gradation currents flow from the power supply driver to each of the signal lines in a selection period; and stationary voltage supply means for supplying a stationary voltage to the signal line to which a potential in accordance with electric charges charged in the signal line by the gradation current is applied, the stationary voltage being higher than a highest gradation voltage in the signal line, which is a voltage in the signal line when a gradation current equal to a highest gradation driving current flowing through the optical element is stationary in the signal line, wherein each driving circuit comprises: (i) a driving transistor, (ii) a current path control transistor having a source connected to the signal line and a drain connected to a source of the driving transistor, and (ii) a data write control transistor having a source connected to a gate of the driving transistor and a drain connected to a drain of the driving transistor, and wherein the power supply driver outputs, to the drain of the driving transistor, a charge voltage for the gradation current and a charge voltage for the driving current.

16. The display apparatus according to claim 15, wherein the stationary voltage supply means comprises:

a transistor for the gradation current, which passes the current having the arbitrary current value; and a transistor for the stationary voltage, which sets a potential of the signal line to the reset voltage.

17. The display apparatus according to claim 15, wherein the stationary voltage applied by the stationary voltage supply means is a voltage which allows electric charges accumulated in a capacity connected to the signal line by the gradation current flowing through the signal line during a selection period to have a predetermined charge amount in a non-selection period.

18. The display apparatus according to claim 15, wherein the stationary voltage applied by the stationary voltage supply means is a voltage which displaces electric charges accumulated in a capacity connected to the signal line by a highest gradation current flowing through the signal line to a predetermined charge amount, wherein a current value of the highest gradation driving current in an emission period is in accordance with a current value of the highest gradation current in the selection period.

19. The display apparatus according to claim 15, wherein the stationary voltage applied by the stationary voltage supply means is a voltage which allows electric charges accumulated in a capacity connected to the signal line by the gradation current flowing through the signal line in a selection period to have a predetermined charge amount in a non-selection period between selection periods, so that the current value of the charge flowing through the signal line is stationary before a next selection period.

20. A driving method of a display apparatus, wherein the display apparatus comprises:

a plurality of scanning lines arranged in a plurality of rows;

a plurality of signal lines arranged in a plurality of columns;

a plurality of pixels, each of which is arranged at an intersection of one of the scanning lines with one of the signal lines, and each of which comprises an optical element which is operated by a driving current, and a pixel circuit which supplies the driving current to the optical element;

a power supply driver connected to the plurality of pixels; and a data driver which is connected to the signal lines and which makes gradation currents flow from the power supply driver to each of the signal lines in a selection period;

wherein the pixel circuit of a given pixel in a given row is connected to one of the scanning lines and one of the signal lines and comprises:

charge hold means for holding electric charges in accordance with the gradation current which flows through the signal line in the selection period of the given row;

driving current switch means for passing the driving current, which has a current value that is substantially equal to a current value of the gradation current in accordance with the electric charges held by the charge hold means, through the optical element of the pixel after the selection period of the given row; and gradation current control switch means for controlling a flow of the gradation current, which flows via the driving current switch means through the signal line;

wherein the driving current switch means comprises a driving transistor;

wherein the gradation current control switch means comprises: (i) a current path control transistor having a source connected to the signal line, and a drain connected to a source of the driving transistor, and (ii) a data write control transistor having a source connected to a gate of the driving transistor, and a drain connected to a drain of the driving transistor;

wherein the power supply driver outputs, to the drain of the driving transistor, a charge voltage for the gradation current and a power voltage for the driving current; and wherein the method comprises:

passing the gradation currents for the pixels of the given row through the signal lines; and resetting a voltage of the signal lines by displacing a potential of the signal lines to a reset voltage from a potential in accordance with electric charges charged in the signal lines by the gradation currents, wherein the reset voltage is higher than a highest gradation voltage in the signal line, which is a voltage in the signal line when a gradation current equal to a current value of a highest gradation driving current flowing through the optical element is stationary in the signal line, the highest gradation driving current being a current flowing through the optical element when the optical element performs an optical operation at a highest gradation.

21. The driving method according to claim 20, wherein the passing of the gradation currents is performed in the selection period, and each of the optical elements performs an optical operation in accordance with the driving current flowing in accordance with the gradation current after the selection period.

22. The driving method of the display apparatus according to claim 20, wherein the resetting is performed after the gradation currents for the pixels of the given row flow through the signal lines and before gradation currents for the pixels of a next row flow through the signal lines.

23. The driving method of the display apparatus according to claim 20, wherein the gradation current control switch means passes the gradation current flowing through the signal line via the driving current switch means in the selection period of the given row to hold the electric charges in the charge hold means, and prevents the driving current from flowing through the signal line in an emission period of the given row.

24. The driving method of the display apparatus according to claim 20, wherein the optical element comprises an organic EL element.

* * * * *